US006653036B1

(12) United States Patent
Tanikawa et al.

(10) Patent No.: US 6,653,036 B1
(45) **Date of Patent: *Nov. 25, 2003**

(54) MAGNETIC TONER AND IMAGE FORMING METHOD

(75) Inventors: Hirohide Tanikawa, Shizuoka-ken (JP); Masami Fujimoto, Shizuoka-ken (JP); Takakuni Kobori, Susono (JP); Hiroyuki Fujikawa, Yokohama (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/153,898

(22) Filed: Sep. 16, 1998

(30) Foreign Application Priority Data

Sep. 16, 1997 (JP) ..... 9-250665

(51) Int. Cl.[7] ..... G03G 9/083

(52) U.S. Cl. ..... 430/106.2; 430/106.1; 430/137.1; 430/120

(58) Field of Search ..... 430/106.6, 106.1, 430/106.2, 120, 132, 137.1

(56) References Cited

U.S. PATENT DOCUMENTS

| | | | | |
|---|---|---|---|---|
| 5,424,810 A | | 6/1995 | Tomiyama et al. | 355/252 |
| 5,885,740 A | * | 3/1999 | Tokunaga et al. | 430/106.6 |

FOREIGN PATENT DOCUMENTS

| | | |
|---|---|---|
| EP | 0592188 | 4/1994 |
| EP | 0699963 | 3/1996 |
| EP | 0750232 | 12/1996 |
| EP | 0794154 | 9/1997 |
| JP | 034070 | 2/1986 |
| JP | 278131 | 12/1987 |
| JP | 072801 | 3/1993 |
| JP | 281778 | 10/1993 |
| JP | 345616 | 12/1993 |
| JP | 110598 | 4/1995 |
| JP | 175262 | 7/1995 |
| JP | 025747 | 1/1996 |
| JP | 101529 | 4/1996 |
| JP | 05902 | 3/1997 |
| JP | 059024 | 3/1997 |

OTHER PUBLICATIONS

Diamond, Arthur S. Handbook of Imaging Materials. New York:Marcel–Dekker, Inc. pp. 159–170, 1991.*

Klein, Cornelis et al. Manual of Mineralogy, New York: John Wiley & Sons. pp. 89–92, 1985.*

* cited by examiner

*Primary Examiner*—Christopher Rodee
(74) *Attorney, Agent, or Firm*—Fitzpatrick, Cella, Harper & Scinto

(57) ABSTRACT

A magnetic toner includes a magnetic toner particle containing a binding resin and a magnetic material. The magnetic material includes a magnetic iron oxide containing 0.10% to 4.00% by weight of an element α belonging to the third period to the seventh period with an atomic number of 11 to 103 and having an electronegativity of 1.0 to 2.5. The solubility $S_1$ of α in the magnetic material at an iron solubility of 0% to 20% is from 10% to less than 44% and the solubility $S_2$ of α at an iron solubility of 80% to 100% is from 5% to less than 30%. The magnetic material contains at least 60% by number of multinuclear magnetic iron oxide particles or at least 60% by number of polyhedral magnetic iron oxide particles having faces at ridgeline portions of hexahedron and/or octahedron multinuclear magnetic iron oxide particles.

34 Claims, 10 Drawing Sheets

POLYHEDRON 1

POLYHEDRON 2
(HEXAHEDRON)

MAGNETIC TONER AND IMAGE FORMING METHOD

BACKGROUND OF THE INVENTION

1. Field of the Invention

The present invention relates to a magnetic toner used in development in image forming methods, such as electrophotography, electrostatic recording and toner jetting. The present invention also relates to an image forming method using the magnetic toner.

2. Description of the Related Art

Various developing methods have been used in practice in electrophotography. Among them, a one-component developing method using a magnetic toner is preferred because the method does not cause troubles and has a prolonged life and eased maintenance by the use of a developer with a simplified structure. In such a developing method, characteristics of the used toner significantly affect the quality of the image formation. The magnetic toner contains a magnetic material for imparting the magnetic property to the toner. Thus, the magnetic material affects the developing characteristics and durability of the magnetic toner. Various improvements have been proposed in terms of magnetic materials.

For example, a magnetic toner containing silicon and zinc is disclosed in Japanese Patent Laid-Open No. 8-101529. Magnetic materials containing silicon are disclosed in Japanese Patent Laid-Open Nos. 7-175262, 5-72801, 62-278131, 61-34070, 8-25747, 9-59024, and 9-59025. Magnetic materials containing silicon and aluminum are disclosed in Japanese Patent Laid-Open Nos. 7-110598 and 5-281778. Further, a magnetic toner containing magnesium is disclosed in Japanese Patent Laid-Open No. 5-345616. Although these magnetic materials have satisfactory developing characteristics, further improvement in their developing characteristics and durability is eagerly awaited, when they are used as a positively charged magnetic toner, when they are used in a high-speed developing machine, when a significantly large volume of copying is performed for a long period while repeatedly supplying the toner, when an amorphous silicon drum is used, or when a reversion developing is performed at a low potential in a digital machine.

SUMMARY OF THE INVENTION

Accordingly, it is an object of the present invention to provide a magnetic toner having excellent developing characteristics and durability.

It is another object of the present invention to provide a magnetic toner having excellent developing characteristics and durability on an amorphous silicon drum.

It is a further object of the present invention to provide a magnetic toner having excellent developing characteristics in low-potential development.

It is a still further object of the present invention to provide a magnetic toner having excellent developing characteristics and durability in a high-speed developing system.

It is another object of the present invention to provide a positively charged magnetic toner having excellent developing characteristics.

It is still another object of the present invention to provide an image forming method using the magnetic toner.

An object of the present invention is to provide a magnetic toner comprising a magnetic toner particle containing at least a binding resin and a magnetic material; wherein the magnetic material comprises a magnetic iron oxide containing 0.10% to 4.00% by weight of an element $\alpha$ from the third period to the seventh period with an atomic member from 11 to 103 in the long-period-type Periodic Table and having an electronegativity of 1.0 to 2.5, the solubility $S_1$ of the element $\alpha$ in the magnetic material at an iron solubility of 0% to 20% lies in a range from 10% to less than 44%, the solubility $S_2$ of the element $\alpha$ in the magnetic material at an iron solubility of 80% to 100% lies in a range from 5% to less than 30%, and the magnetic material contains (i) 60% by number or more of a type of multinuclear magnetic iron oxide particle, based on magnetic iron oxide particles, or (ii) 60% by number or more in total, based on magnetic iron oxide particles, of at least one type of magnetic iron oxide particle selected from the group consisting of polyhedral magnetic iron oxide particles having faces at ridgeline portions of hexahedron and polyhedral magnetic iron oxide particles having faces at ridgeline portions of octahedron, in combination with a type of multinuclear magnetic iron oxide particle.

Another object of the present invention is to provide an image forming method comprising a step of forming an electrostatic image on a latent image carrier and a step of developing the electrostatic image with a magnetic toner to form a magnetic toner image; wherein the magnetic toner comprises a magnetic toner particle containing at least a binding resin and a magnetic material; wherein the magnetic material comprises a magnetic iron oxide containing 0.10% to 4.00% by weight of an element $\alpha$ from the third period to the seventh period with an atomic member from 11 to 103 in the long-period-type Periodic Table and having an electronegativity of 1.0 to 2.5, the solubility $S_1$ of the element $\alpha$ in the magnetic material at an iron solubility of 0% to 20% lies in a range from 10% to less than 44%, the solubility $S_2$ of the element $\alpha$ in the magnetic material at an iron solubility of 80% to 100% lies in a range from 5% to less than 30%, and the magnetic material contains (i) 60% by number or more of a type of multinuclear magnetic iron oxide particle, based on magnetic iron oxide particles, or (ii) 60% by number or more in total, based on magnetic iron oxide particles, of at least one type of magnetic iron oxide particle selected from the group consisting of polyhedral magnetic iron oxide particles having faces at ridgeline portions of hexahedron and polyhedral magnetic iron oxide particles having faces at ridgeline portions of octahedron, in combination with a type of multinuclear magnetic iron oxide particle.

Further objects, features and advantages of the present invention will become apparent from the following description of the preferred embodiments with reference to the attached drawings.

DESCRIPTION OF THE PREFERRED EMBODIMENT

The magnetic material of the magnetic toner of the present invention is composed of a magnetic iron oxide which involves an element α. Since the element α is distributed from the surface to the center of the crystal particle of the magnetic iron oxide in the present invention, the magnetic characteristics of the magnetic material are well balanced. Thus, the image density is enhanced and fogging is reduced. Further, charge stability is improved by controlling the electrical characteristics of the crystal particle surfaces. In order to improve durability, the magnetic material contains multinuclear magnetic iron oxide particles, or polyhedral magnetic iron oxide particles having faces at ridgeline portions of hexahedron and octahedron in combination with the multinuclear magnetic iron oxide particles. The content of the multinuclear particles is preferably 50% by number or more and more preferably 60% by number or more based on magnetic iron oxide particle.

Figure 1:
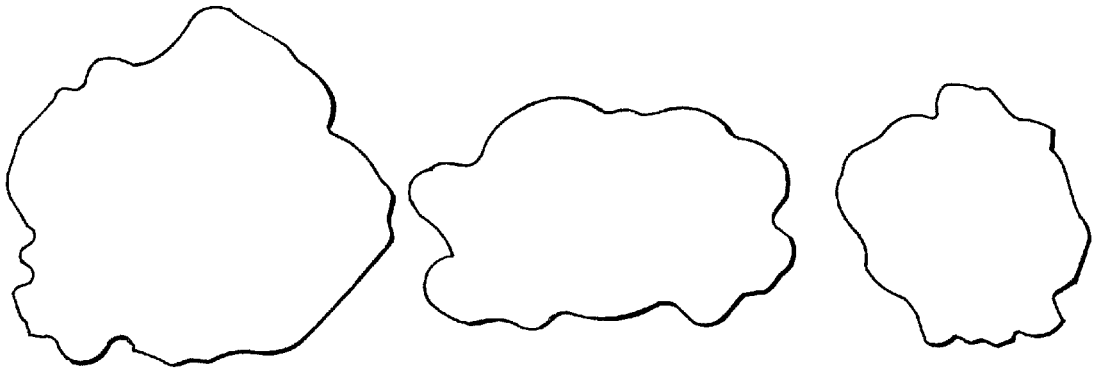
FIG. 1 is a schematic view illustrating outlines of multinuclear magnetic iron oxide particles.
Figure 2:
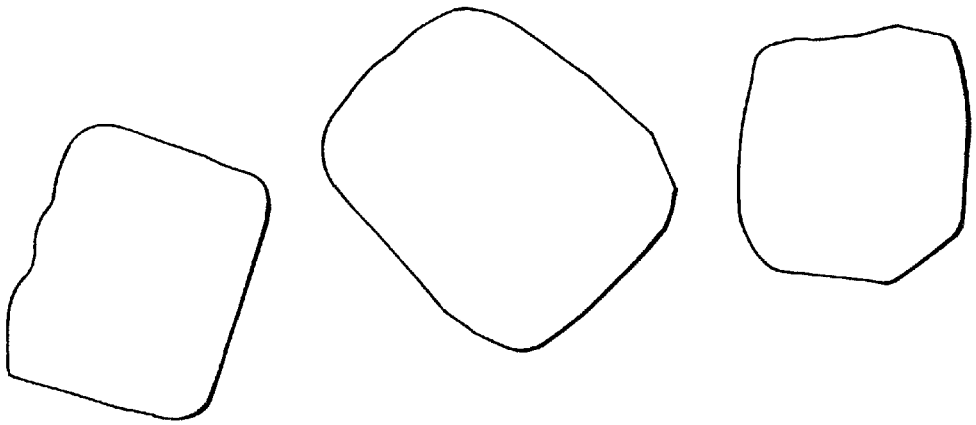
FIG. 2 is a schematic view illustrating outlines of polyhedral magnetic iron oxide particles having faces at ridgeline portions of hexahedron and octahedron.

The multinuclear particle represent a particle formed by crystal growth from a plurality of nuclei or by crystal growth from a plurality of small nuclei on a parent particle. The multinuclear particle has protrusions consisting of faces and edge lines. FIG. 1 shows outlines of such multinuclear particles. FIG. 2 shows outlines of polyhedral particles having faces at ridgeline portions of hexahedron and octahedron.

Figure 3:
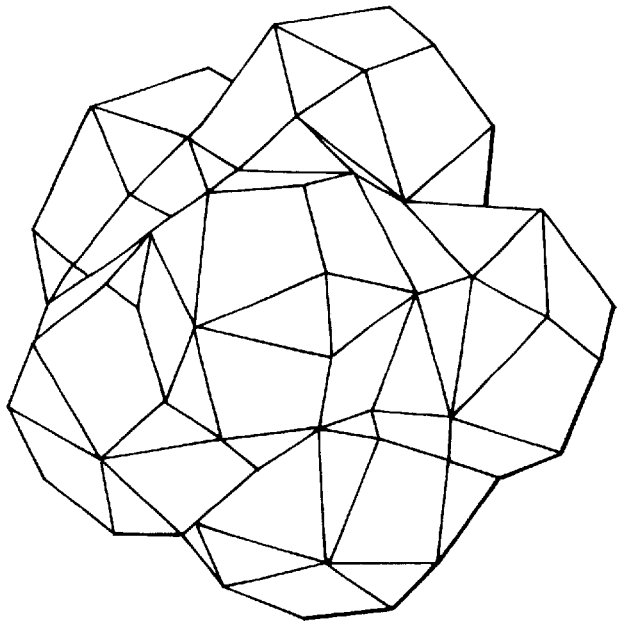
FIG. 3 is a stereographic view of a multinuclear magnetic iron oxide particle.
Figure 4:
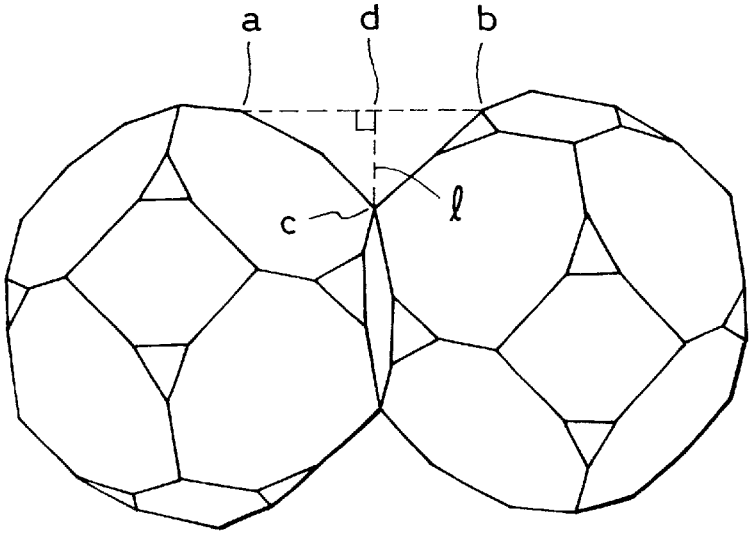
FIG. 4 is a stereographic view of a multinuclear magnetic iron oxide particle.
Figure 5:
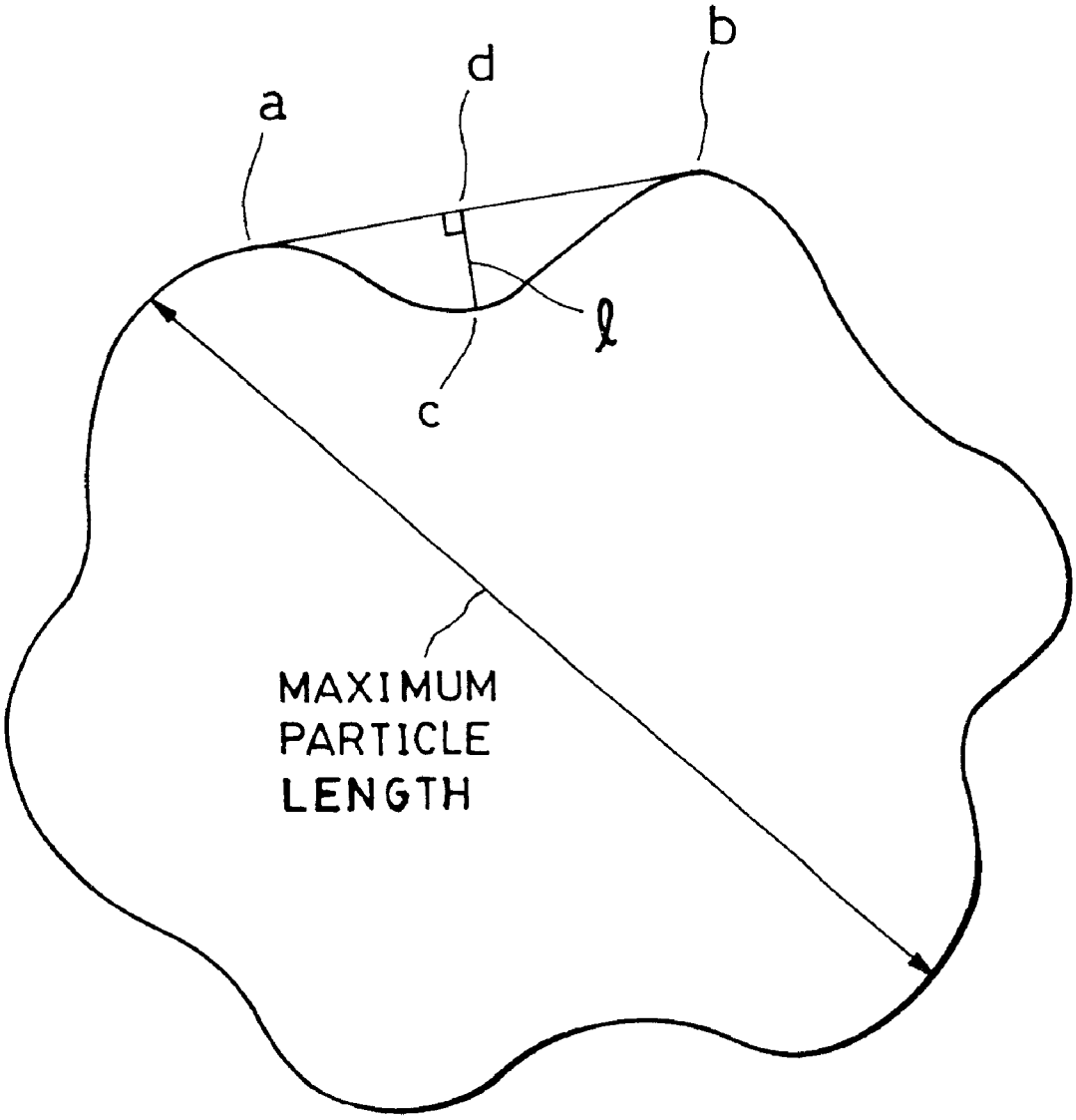
FIG. 5 is a projection view illustrating the outline of a multinuclear magnetic iron oxide particle.
Figure 6A:
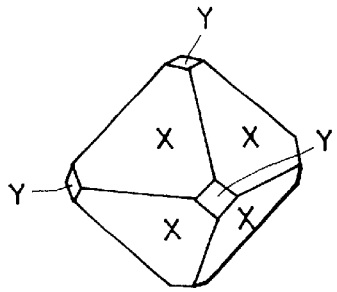
FIGS. 6A to 6G are stereographic views of polyhedral iron oxide particles having faces at ridgeline portions of hexahedron and octahedron.
Figure 6B:
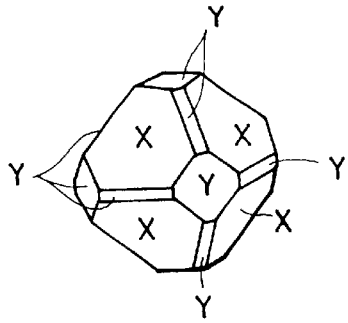
Figure 6C:
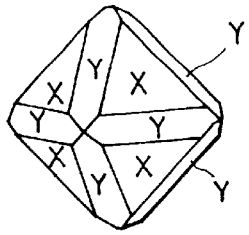
Figure 6D:
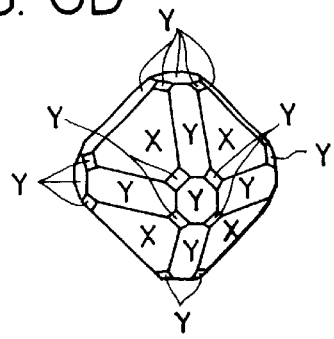
Figure 6E:
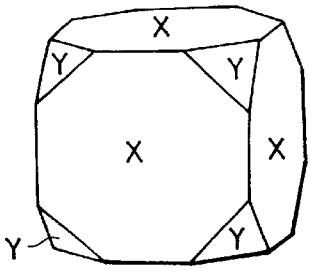
Figure 6F:
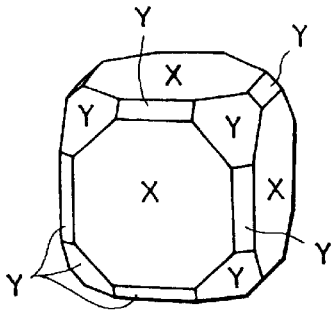
Figure 6G:
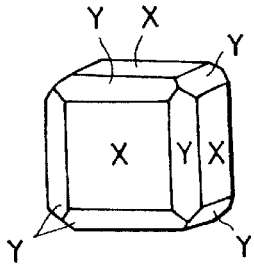

A preferred embodiment of the shape of the multinuclear magnetic iron oxide particle is as follows. Suppose a straight line connecting any two apices on a particle. In the multinuclear shape, surfaces lie towards the particle center with respect to the straight line, as faces of an indented portion. A multinuclear particle has at least one indented portion. FIGS. 3 and 4 are stereographic views of typical multinuclear particles. The length of a perpendicular line from the straight line to the face is preferably 1.0% to 50.0%, more preferably 2.0% to 40.0%, and most preferably 3.0% to 30.0% of the maximum diameter of the particle. With reference to FIG. 4 and FIG. 5, symbol l represents the length of a perpendicular line from the point d on the straight line ab between the two apices a and b to the face c. When the contour of a planar objection satisfies the above-mentioned conditions as shown in FIG. 5, the particle satisfies the shape specified in the present invention.

Figure 7A:
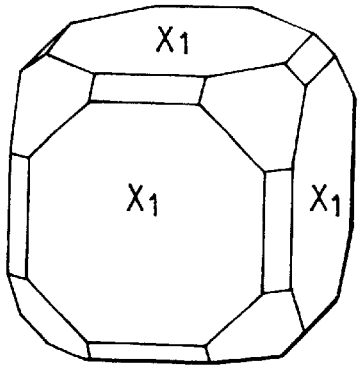
FIGS. 7A to 7C are stereographic schematic views illustrating side face extrapolation.
Figure 7B:
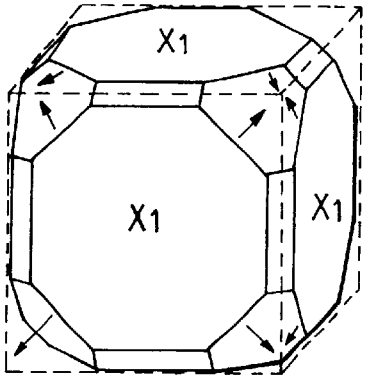
Figure 7C:
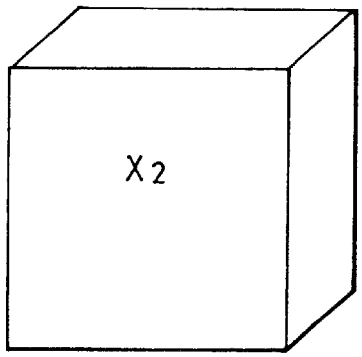

Preferable shapes of the polyhedral magnetic iron oxide particle having faces at ridgeline portions of hexahedron and octahedron are as follows. The extrapolated faces of the polyhedron involving magnetic iron oxide particles form a hexahedron or octahedron Examples of hexahedrons and octahedrons are shown as stereographic views in FIGS. 6A to 6G and 7A. In FIGS. 6A to 6G, the surface X represents a side face and the surface Y represents a face at ridgeline portion. The face may be a flat surface or a curved surface. With reference to FIGS. 7A to 7C, based on a polyhedron 1 having faces $X_1$ (FIG. 7A), another polyhedron 2 having faces $X_2$ is extrapolated (FIG. 7B). On the polyhedron having faces at ridgeline portions in accordance with the present invention, the polyhedron 2 (FIG. 7C) formed by the extrapolation is a hexahedron or octahedron.

Magnetic iron oxide particles having such a shape have significantly high dispersibility and thus are suitable for production of uniform toner particles. Since the magnetic particles can sufficiently disperse into a binding resin by small kneading shear, they have high compatibility with a wide range of materials. Further, they improve electrophotographic characteristics and can be produced with a stable process. The particles having no sharp ridgelines or tops barely agglomerate together and thus can uniformly disperse into the binding resin. Since the magnetic iron oxide particles have surface unevenness and many ridgelines between faces, they have high adhesiveness to the binding resin. Thus, the particles are physically fixed onto the magnetic toner surface to prevent detachment from the magnetic toner particles. The magnetic iron oxide particles are exposed at the magnetic toner surface, hence the particles can more effectively contribute to charge control. As a result, the magnetic toner has high flowability and thus significantly contributes to stabilization of developing characteristics in high-speed development. The hexahedron particles, octahedron particles and spherical particles may be contained in an amount of less than 40% by number of magnetic iron oxide particles. The content is preferably 20% by number or less and more preferably 10% by number or less. An increase in number of spherical particles causes an increase in number of free magnetic particles detached from the magnetic toner particles and thus abrasion of a photosensitive drum. An increase in number of hexahedron or octahedron particles causes vertex exposure of magnetic iron oxide particles on the surfaces of the magnetic toner particles and thus inhibition of charge control and flowability.

Inclusion of atoms other than iron atoms in magnetic iron oxide imparts excellent magnetic and electrical characteristics to the particles. These atoms are preferably present in the magnetic iron oxide crystal so that these atoms are substituted for iron atoms. Preferred atoms are of an element α having M shell which belongs to the third period to the seventh period in the long-period-type Periodic Table with an atomic number from 11 to 103. The element α is preferably an element belonging to the third, fourth or fifth period, and more preferably to the third or fourth period. Since it is preferred that the element α has electronegativity which is similar to that of iron, the electronegativity of the element α is desirably 1.0 to 2.5, preferably 1.2 to 2.3, and more preferably 1.5 to 2.1. For example, as the element α, Na, Mg, Al, Si, P, K, Ca, Sc, Ti, B, Cr, Mn, Fe, Co, Ni, Cu, Zn, Ga, Ge, As, Zr, In, Sn, Sb, Tl, Bd, and Bi are typical examples. Examples of preferred elements α include Si, Al, P, Ti, V, Cr, Mn, Co, Ni, Cu, Zn, Ga, Ge, Zr, Sn and Pb. Examples of more preferred element include Si, Al, P, V, Cr, Co, Ni, Cu, Zn, Ga, Ge, Zr, Sn and Pb. Among them, Si, Al and P are further preferred. Si is most preferred.

The element α is included in the magnetic iron oxide in an amount of 0.10% to 4.00% by weight of the magnetic material. The magnetic material can have a preferred shape when the content lies within the range. Distribution of the element α imparts excellent electrophotographic characteristics including magnetic, electrical and physical characteristics to the magnetic toner. Thus, the magnetic toner has excellent developing characteristics and durability under severe conditions. A content of higher than 4.00% by weight tends to form curved faces on the polyhedron, that is, to form a sphere. A spherical magnetic material will easily detach from the magnetic toner particles. The detached magnetic materials cause uneven drum abrasion through long-time use, and thus uneven surface potential on the drum. Since low-potential development often occurs on an amorphous silicon drum, the potential is significantly low in the case of reversal development of a digital latent image, resulting in irregular image density. The detached magnetic materials also cause excessive discharge, hence the image density easily decreases at high humidity because of reduced charge of the magnetic toner. A content of less than 0.10% by weight causes excessive charge of the magnetic toner, and thus a large amount of fogging because of nonuniform charge between the magnetic toner particles. The content preferably ranges from 0.15% to 3.00% by weight in order to achieve stabilization of charge and developing characteristics. The content more preferably ranges from 0.20% to 2.50% by weight in order to achieve an image having a higher image density and decreased fogging. The most preferred content ranges from 0.50% to 2.00% by weight.

Preferably, the element $\alpha$ is uniformly distributed to all the parts of the magnetic material. The solubility $S_1$ of the element $\alpha$ in the magnetic material at an iron solubility of 0% to 20% lies in a range from 10% to less than 44%, and the solubility $S_2$ of the element $\alpha$ in the magnetic material at an iron solubility of 80% to 100% lies in a range from 5% to less than 30%. Such a magnetic material has excellent wettability and affinity with a binding resin, and is firmly fixed even on the surface of the magnetic toner particle. Thus, the magnetic material can be prevented from detachment from the magnetic toner particle, and thus from the drum abrasion, unsatisfactory cleaning, and defects of the cleaning blade. In an amorphous silicon drum, these advantages are noticeable.

A $S_1$ of 10% or more and less than 44% causes a relatively low residual magnetization and thus a high image density. Further, multinuclear particles can be readily formed. These particles contribute to improvement in dispersibility and adhesiveness, and excellent durability. In some cases, the surface contains a desired amount of oxide of the element $\alpha$, hence the oxide exposed from the surface of the magnetic toner particle can effectively control charging, prevent agglomeration of toner particles, maintain flowability of the toner particles, stabilize charging of the toner particles, and stabilize developing through long-time use.

A $S_2$ of 5% or more and less than 30% causes the saturation magnetization to be retained, an excessive decrease in residual magnetization to be prevented and the ratio of the residual magnetization to the saturation magnetization to be retained. Thus, fogging is suppressed while maintaining a high image density. Further, magnetic characteristics are stabilized among magnetic particles, hence magnetic characteristics are stabilized in a toner particle and among toner particles. As a result, selective development of particular particles can be prevented. The magnetic particles have a small variation in particle size, and contribute to excellent dispersibility and durability.

The magnetic toner satisfying the above-mentioned $S_1$ and $S_2$ values in accordance with the present invention is particularly effective in low-potential development such as reversal development.

A solubility $S_1$ of 44% or more causes enrichment of oxide of the element $\alpha$ on the particle surface of the magnetic material, hence the particle cannot maintain the above-described shape. As a result, free magnetic material will wear away the drum surface. Further, the surface area per unit weight of the magnetic material increases, hence triboelectric charging is significantly released. Since the magnetic material cannot maintain desired charge, image defects such as irregular image density, fogging and density reduction will easily form when the magnetic toner is repeatedly supplied or applied as a positively charging toner. In addition, the ratio of the residual magnetization to the saturation magnetization decreases, hence fogging will frequently occur in low-potential development. The wettability with the binding resin is lowered, hence the magnetic material will easily detach from the magnetic toner particles. A solubility $S_1$ of less than 10% causes an increased ratio of the residual magnetization to the saturation magnetization, hence a high image density will be achieved with difficulty at low-potential development. Further, multinuclear particles will barely form, hence dispersibility into the binding resin and adhesiveness to the binding resin are decreased. When insufficient dispersion occurs, the image density will often decrease and fogging will often occur through long-time use. The solubility $S_1$ preferably ranges from 15% to 42%. In this case, satisfactory compatibility is achieved between drum durability and developing characteristics. The solubility $S_1$ more preferably ranges from 20% to 40%. In this case, a sharp, high-quality image with high resolution is obtainable.

When the solubility $S_2$ is larger than 30%, the abundance of the element $\alpha$ near the particle surface of the magnetic material decreases, hence polyhedral particles having faces at ridgeline portions or multinuclear particles will be formed with difficulty, resulting in decreased dispersibility into the binding resin. Insufficient dispersion will cause a decrease in image density through long-time use. The content of the element $\alpha$ easily varies near the surfaces of individual magnetic material particles. Thus, charging is unstable, resulting in fogging. When the solubility $S_2$ is less than 5%, the size of the magnetic material particles is irregular. Thus, the magnetic material particles look reddish. Further, nonuniform magnetic toner particles are formed, resulting in frequent selective development and deterioration of developing characteristics. The solubility $S_2$ preferably ranges from 5% to less than 25%. In this case, blackness is stabilized and developing characteristics barely change through long-time use. The solubility $S_2$ more preferably ranges from 10% to less than 20%. In this case, the magnetic material particles are preferably applicable to high-speed development using an amorphous silicon drum or a high-durability machine.

It is preferred that the solubility $S_1$ and the solubility $S_2$ satisfy $S_1 \geqq S_2$. In such a case, stabilization of the particle size and formation of multinuclear particles are prompted. As a result, developing characteristics and durability are improved. Developing characteristics are significantly improved for positively charging toners which show difficulty in charging balance.

In general, binding resins used in toners have negatively charging characteristics. In positively charging toners, controlling agents for positively charging characteristics are dispersed into binding resins to prepare positively triboelectric toners. When such toners are triboelectrically charged, the toners are positively charged in a macroscopic view, but they have negatively charged portions in a microscopic view. Such a phenomenon causes nonuniform charging. Thus, some toner particles have unbalanced discharging characteristics, resulting in fogging, a decreased image density, and selective development. The magnetic material in accordance with the present invention having exposed faces moderates nonuniform charging, and thus uniformly stabilizes positive charging. Accordingly, the magnetic toner in accordance with the present invention can be preferably used for positively charging toners.

It is preferable that the solubility $S_3$ of the element α at an iron solubility of 20% to 80% lies within a range from 10% to less than 25%, wherein the solubility $S_3$ corresponds to the solubility of the element α per 20% of the iron solubility. In such a case, the abundance of the element α smoothly changes, hence homogenization of the magnetic material is prompted and magnetic characteristics of particles are stabilized. Thus, magnetic characteristics of magnetic toner particles are also stabilized. Such a magnetic toner can suppress selective development and has high durability.

Since the above-described abundance of the element α can stabilize the coercive force within a desired range, the compatibility between suppression of fogging and a high image density can be achieved. Further, polyhedral particles having faces at ridgeline portions of hexahedron and octahedron and multinuclear particles can be easily formed. These particles contribute to improved dispersibility and adhesiveness, and charge stabilization and improved flowability when the faces are exposed. Accordingly, the particles have excellent developing characteristics and stabilized durability. A solubility $S_3$ of less than 10% causes fogging due to a decreased coercive force and abrasion of the photosensitive drum due to increased spherical particles. A solubility $S_3$ of 25% or more causes a decreased image density due to an increased coercive force and deterioration of charging control and flowability due to increased hexahedron and/or octahedron particles.

It is preferable that the solubility $S_1$, the solubility $S_2$, and the solubility $S_3$ satisfy $S_1>S_2$, $S_1 \geqq S_3$ and $S_3 \geqq S_2$ in order to stabilize the particle size, to prompt the formation of polyhedral particles having faces at ridgeline portions of hexahedron and octahedron, and to improve developing characteristics and durability. In addition, the resulting toner and in particular the positively charging toner is homogenized by moderated charging.

The amount of the element α lying as an oxide on the surface of the magnetic material particle is desirably 0.01% to 1.00% by weight, preferably 0.02% to 0.75% by weight, more preferably 0.03% to 0.50% by weight, and most preferably 0.05% to 0.50% by weight based on the magnetic iron oxide. On the other hand, when the amount of the element α lying on the surface of the magnetic material particle is 2% to 25% by weight and preferably 4% to 20% by weight of the total amount of the element α in the magnetic iron oxide, retention and leakage of charging are satisfactorily balanced. Further, the element α functions as a charging buffer of magnetic toner particles, and suppresses the formation of reversibly charging particles. Thus, fogging caused by the toners reaching the reversal section are reduced. The charge retention ability is dominant for less than 2% by weight of the element α lying on the surfaces of the magnetic iron oxide particles, whereas the charge leakage ability is dominant for more than 25% by weight of the element α.

In a preferred embodiment, an element β other than the element α is present on the magnetic material. The element β is selected from the Groups II, III, IV and V of the Periodic Table, and is present as an ampholytic oxide and/or an ampholytic hydroxide. The content of the element β is preferably 0.01% to less than 2.0% by weight of the magnetic material in order to improve environmental stability, that is, a decreased difference in developing characteristics between low-humidity and high-humidity. Such an advantage is not achieved at an element β content of less than 0.01% by weight, whereas flowability is decreased at an element β content of 2.00% by weight or more, resulting in deterioration of durability. Examples of preferred elements β include B, Al, Si, Cd, Ga, In, Ge, Sn, Pb, As, Sb and Bi. Among them, B, Al and Si are more preferred.

The number-average particle diameter of the magnetic material is in a range of preferably 0.05 to 0.50 μm, more preferably 0.08 to 0.40 μm, and most preferably 0.10 to 0.30 μm, in order to have uniform dispersibility. The BET specific surface area of the magnetic material is in a range of preferably 5.0 to 20.0 $m^2/g$, more preferably 6.0 to 15.0 $m^2/g$, and most preferably 8.0 to 12.0 $m^2/g$, in order to improve environmental stability of development.

Regarding the magnetic characteristics of the magnetic material, the saturation magnetization is in a range of preferably 75 to 100 $Am^2/kg$, more preferably 80 to 95 $Am^2/kg$, and most preferably 85 to 90 $Am^2/kg$, in order to sufficiently suppress fogging. The residual magnetization is in a range of preferably 5.0 to 12.0 $Am^2/kg$, more preferably 6.0 to 11.0 $Am^2/kg$, and most preferably 7.0 to 10.0 $Am^2/kg$, in order to achieve a high density image. The coercive force is in a range of preferably 5.0 to 10.0 kA/m, more preferably 5.5 to 9.0 kA/m, and most preferably 6.0 to 8.5 kA/m, in order to accurately develop a digital latent image. The ratio or/as of the residual magnetization or to the saturation magnetization as is in a range of preferably 0.070 to 0.125, more preferably 0.080 to 0.115, and most preferably 0.085 to 0.110 in order to enhance an image density and reduce fogging. These magnetic characteristics are measured in a magnetization field of 795.8 kA/m. The magnetic material is compounded in an amount of preferably 20 to 200 parts by weight, more preferably 40 to 150 parts by weight, and most preferably 50 to 120 parts by weight to 100 parts by weight of a binding resin. At a content of less than 20 parts by weight, magnetic characteristics and charging characteristics are unsatisfactorily balanced, resulting in an increased fogging, excessive charge, troubles under low humidity environments, and insufficient coloring. Also, at a content of higher than 200 parts by weight, magnetic characteristics and charging characteristics are unsatisfactorily balanced, resulting in a decreased image density, deterioration of image quality, insufficient charging, troubles under high humidity environments, and insufficient fixing.

The methods for determining the parameters of the magnetic material are described below.

(1) Content of Element α

The content of the element α in the magnetic material is determined by fluorescent X-ray analysis based on JIS K0119 "General Rule of Fluorescent X-ray Analysis" using a Fluorescent X-ray Analysis SYSTEM 3080 made by Rigaku Industrial Corporation.

(2) Solubility of Iron and Solubility of Element α

The solubility of iron and the solubility S of the element α are determined as follows. Approximately 3 liters of deionized water is placed into a 5-1 beaker, and heated to 45° C. to 50° C. in a water bath. Slurry of approximately 25 g of magnetic material in approximately 400 ml of deionized water is added to the beaker using approximately deionized water for washing. Reagent grade hydrochloric acid is added to the beaker to start dissolution while maintaining the temperature at approximately 50° C. and the stirring rate to approximately 200 rpm, wherein the concentration of magnetic iron oxide is approximately 5 g/l and the concentration of the hydrochloric acid is approximately 3 mol/l. After the magnetic iron oxide begins to dissolve and before it is completely dissolved, at suitable intervals, ten lots of 10-ml samples are withdrawn and filtered by a 0.1-$\mu$m membrane filter. Each filtrate is analyzed by induced coupled plasma (ICP) spectrometry to determine the concentrations of iron and the element $\alpha$.

The solubility of iron and the solubility of the element $\alpha$ are calculated by the following equations:

Solubility of iron={(concentration (mg/l) of iron in the sample)/(concentration (mg/l) of the completely dissolved iron)}×100

Solubility of element $\alpha$={(concentration (mg/l) of element $\alpha$ in the sample)/(concentration (mg/l) of the completely dissolved element $\alpha$)}×100

Figure 10:
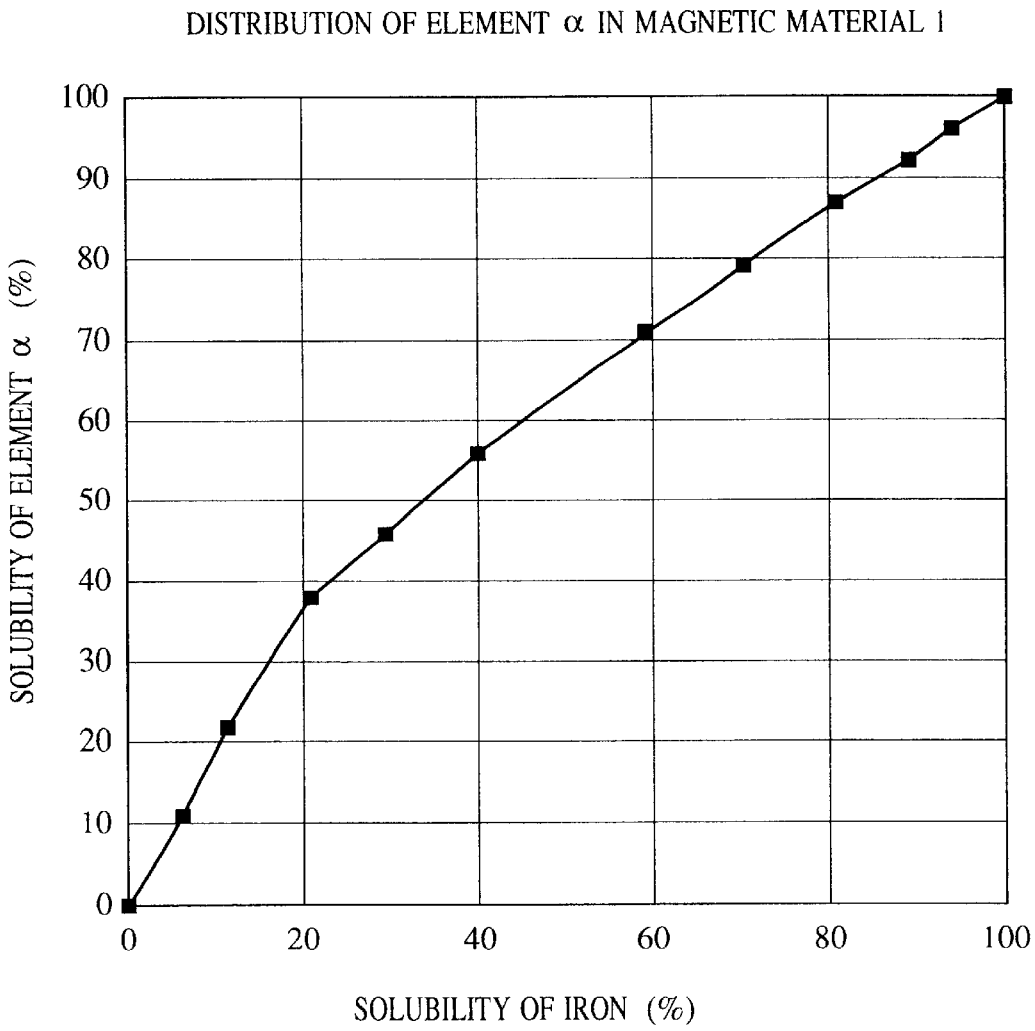
FIG. 10 is a graph of solubility of an element α in a magnetic material 1.

Dissolution curves as shown in FIG. 10 are plotted from these results to determine $S_1$, $S_2$ and $S_3$ as follows.

The solubility $S_1$ represents the solubility of the element $\alpha$ at an iron solubility of 0% to 20%. Thus, the solubility $S_1$ corresponds to the solubility of the element $\alpha$ for an iron solubility of 20%.

The solubility $S_2$ represents the solubility of the element $\alpha$ at an iron solubility of 80% to 100%. Thus, the solubility $S_2$ corresponds to the difference between the solubility of the element $\alpha$ for an iron solubility of 100% and the solubility of the element $\alpha$ for an iron solubility of 80%.

The solubility $S_3$ represents the solubility of the element $\alpha$ per 20% of the iron solubility which is converted from the solubility of the element $\alpha$ in the region of an iron solubility of 20% to 80%. Thus, the solubility $S_3$ corresponds to one-third the difference value between the solubility of the element $\alpha$ for an iron solubility of 80% and the solubility of the element $\alpha$ for an iron solubility of 20%.

(3) Particle Diameter and Shape of Magnetic Material

An electron-microscopic photograph of magnetic iron oxide particles is taken using an electron microscope H-700H (made by Hitachi, Ltd.) at a magnification of ×50,000. The photograph is enlarged to a final magnification of ×100,000. One-hundred particles of 0.03 $\mu$m or more are selected at random and the maximum lengths of the particles are measured. The number-average particle diameter is calculated from the mean value of the maximum lengths.

Photographs of a magnification of ×100,000 are taken using electron microscopes H-700H and S-4700 (made by Hitachi, Ltd.) and enlarged to a final magnification of ×200,000. One-hundred particles of 0.05 $\mu$m or more are selected at random and the shapes of these particles are observed to determine the abundance (number) of the particles having specified shapes. One-hundred multinuclear particles are selected at random in the enlarged photograph with a final magnification of ×200,000, and the ratio of the longest line cd of each particle to the maximum length of each particle is determined as shown in FIG. 5. The maximum depth of the indented section of the magnetic material having a multinuclear shape corresponds to the average of the ratios of these particles.

In the measurement of the particle diameter and shape of the magnetic material, a photograph may be taken using a transmittance electron microscope (TEM) H-700H, H-800, or H-7500 made by Hitachi, Ltd., or a scanning electron microscope (SEM) S-800 or S-4700 made by Hitachi, Ltd. The magnification may be within a range of ×20,000 to ×200,000, and the final or enlarged magnification may be within a range of ×1 to ×10.

(4) Content of Element $\alpha$ on Surface of Magnetic Material

Into a 300-ml plastic vessel, 250 ml of deionized water and 20 g of a sample are placed. These are sufficiently stirred with a homomixer to prepare slurry. Into a 1-liter stainless steel vessel, 200 ml of the slurry and 200 ml of a 2-mol/l NaOH solution are placed, and the slurry is heated with stirring to 40° C. and stirred for 30 minutes. The slurry is filtered and washed with 500 ml of pure water. The resulting cake is dried at 60° C. for 8 hours. The content of the element $\alpha$ in the cake is determined according to the above-mentioned procedure (1). The content of the element $\alpha$ on the surface of the magnetic material is defined as the difference in the content of the element $\alpha$ between the untreated sample and the treated sample based on the magnetic material.

(5) Determination of Element $\beta$

The content of the element $\beta$ based on the magnetic material is determined according to the above-mentioned procedure (4).

(6) BET Specific Surface Area

The BET specific surface area is determined by a BET multipoint method using an automatic gas adsorption meter Autosorb 1 made by Yuasa Ionics Co., Ltd. with nitrogen as a gaseous adsorbate. The sample is deaerated at 50° C. for 1 hour.

(7) Magnetic Characteristics of Magnetic Material

The magnetic characteristics of the magnetic material are determined using a vibrating sample-type magnetometer VSM-3S-15 made by Toei Kogyo Co., Ltd. under an external magnetic field of 795.8 kA/m.

Examples of binding resins used in the magnetic toners in accordance with the present invention include styrene homopolymers, e.g. polystyrene, poly-p-chlorostyrene, and polyvinyltoluene; styrene copolymers, e.g. styrene-p-chlorostyrene copolymers, styrene-vinyltoluene copolymers, styrene-acrylic ester copolymers, styrene-methacrylic ester copolymers, styrene-methyl-$\alpha$-chloromethacrylate copolymers, styrene-acrylonitrile copolymers, styrene-vinyl methyl ether copolymers, styrene-vinyl ethyl ether copolymers, styrene-vinyl methyl ketone copolymers, styrene-butadiene copolymers, styrene-isoprene copolymers, and styrene-acrylonitrile-indene terpolymers; and miscellaneous resins, e.g. polyvinyl chloride, phenol resins, natural resin-modified phenol resins, natural resin-modified maleic resins, acrylic resins, methacrylic resins, polyvinyl acetate, silicone resins, polyester resins, polyurethanes, polyamide resins, furan resins, epoxy resins, xylene resins, polyvinyl butyral, terpene resins, coumarone-indene resins, and petroleum resins. Among them, styrene copolymers and polyester resins are preferred.

Examples of comonomers in the styrene copolymers include substituted or unsubstituted monocarboxylic acids having a double bond, e.g. acrylic acid, methyl acrylate, ethyl acrylate, butyl acrylate, dodecyl acrylate, octyl acrylate, 2-ethylhexyl acrylate, phenyl acrylate, methacrylic acid, methyl methacrylate, ethyl acrylate, butyl acrylate, octyl methacrylate, acrylonitrile, methacrylonitrile, and acrylamide; substituted or unsubstituted dicarboxylic acids having a double bond, e.g. maleic acid, butyl maleate, methyl maleate, and dimethyl maleate; vinyl esters, e.g. vinyl chloride, vinyl acetate, and vinyl benzoate; ethylenic olefins, e.g. ethylene, propylene, and butylene; vinyl ketones, e.g. vinyl methyl ketone and vinyl hexyl ketone; and vinyl ethers, e.g. vinyl methyl ether, vinyl ethyl ether, and vinyl isobutyl ether. These vinyl monomers may be used alone or in combination.

The styrene homopolymers and copolymers may be crosslinked and may be used as a mixture thereof.

The crosslinking agent for the binding resin may be a polymerizable compound having at least two double bonds.

Examples of such compounds include aromatic divinyl compounds, e.g. divinylbenzene and divinylnaphthalene; carboxylate esters having two double bonds, e.g. ethylene glycol diacrylate, ethylene glycol dimethacrylate, and 1,3-butanediol dimethacrylate; divinyl compounds, e.g. divinylaniline, divinylethers, divinylsulfide, and divinylsulfone; and compounds having at least three divinyl groups. These crosslinking agents may be used alone or in combination.

The styrene copolymer may be prepared by bulk polymerization, solution polymerization, suspension polymerization or emulsion polymerization. In bulk polymerization, high temperature polymerization is suitable for preparation of a low-molecular-weight polymer because of accelerated termination, but it is difficult to control the reaction. In solution polymerization, a low-molecular weight polymer is easily prepared under moderated conditions by means of a difference in chain transfer between radicals in the solvent and by controlling the amount of an initiator and the reaction temperature. The solution polymerization is preferred when polymerizing a low-molecular-weight polymer having a maximum molecular weight distribution in a range of 5,000 to 100,000 according to a GPC chromatogram.

Examples of solvents used in the solution polymerization include xylene, toluene, cumene, isopropyl alcohol, and benzene. Solvents suitable for a styrene monomer mixture are xylene, toluene and cumene. A desired solvent may be selected depending on the formed polymer.

The reaction temperature depends on the solvent, the initiator, and the polymer, and is generally in a range of 70° C. to 230° C. In the solution polymerization, 30 to 400 parts by weight of a monomer is preferably dissolved into 100 parts by weight of a solvent. After the completion of the polymerization, other polymers may be mixed with the resulting polymer.

Emulsion polymerization and suspension polymerization are methods suitable for preparing a high-molecular weight polymer having a maximum molecular weight distribution of 100,000 or more according to a GPC chromatogram or a crosslinked polymer. In the emulsion polymerization, a monomer which is not substantially soluble in water is dispersed into an aqueous phase as fine particles using an emulsifier and polymerized with an aqueous initiator. This method is capable of easily controlling the reaction heat. Since the polymerizing phase (an oil layer composed of the polymer and the monomer) is separated from the aqueous phase, the termination rate is small, and thus the reaction rate is high. Thus, a high-molecular-weight polymer is obtained. The emulsion polymerization has further advantages, e.g. a simplified polymerization process and production of a fine particle polymer. In toner production, the resulting fine particle polymer can be easily mixed with additives, such as a coloring agent and a charge-controlling agent. Accordingly, the emulsion polymerization is suitable for producing a binding resin for toners.

The polymer by the emulsion polymerization, however, has low purity because of the emulsifier used in the process. Further, the emulsion polymerization requires an additional process, that is, salting-out for recovering the polymer. A more simplified method is suspension polymerization.

In suspension polymerization, 100 parts by weight or less and preferably 10 to 90 parts by weight of monomer is dissolved into 100 parts by weight of an aqueous solvent. Examples of usable dispersants include polyvinyl alcohol, partially saponified polyvinyl alcohol, and calcium phosphate. The amount of the dispersant is determined depending on the monomer content in the aqueous solvent and the like. In general, 0.05 to 1 part by weight of dispersant is used to 100 parts by weight of aqueous solvent. The preferable temperature lies within a range of 50° C. to 95° C. and is determined by types of the initiator and the targeted polymer. Any initiator insoluble or slightly soluble to water can be used in the suspension polymerization.

Examples of the initiators include tert-butyl peroxy-2-ethylhexanoate, cumin perpivalate, tert-butyl peroxy laurate, benzoyl peroxide, lauroyl peroxide, octanoyl peroxide, di-tert-butyl peroxide, tert-butyl cumyl peroxide, dicumyl peroxide, 2,2'-azobisisobutyronitrile, 2,2'-azobis(2-methylbutyronitrile), 2,2'-azobis(2,4-dimethylvaleronitrile), 2,2'-azobis(4-methoxy-2,4-dimethylvaleronitrile), 1,1-bis(tert-butyl peroxy)-3,3,5-trimethylcyclohexane, 1,1-bis(tert-butyl peroxy)cyclohexane, 1,4-bis(tert-butyl peroxycarbonyl)cyclohexane, 2,2-bis(tert-butyl peroxy) octane, n-butyl-4,4-bis(tert-butyl peroxy)valylate, 2,2-bis(tert-butyl peroxy)butane, 1,3-bis(tert-butyl peroxy-isopropyl)benzene, 2,5-dimethyl-2,5-di(tert-butyl peroxy) hexane, 2,5-dimethyl-2,5-di(benzoyl peroxy)hexane, di-tert-butyl peroxy isophthalate, 2,2-bis(4,4-(tert-butyl peroxy cyclohexyl)propane, di-tert-butyl peroxy-α-methylsuccinate, di-tert-butyl peroxy dimethylglutalate, di-tert-butyl peroxy hexahydroterephthalate, di-tert-butyl peroxy azelate, 2,5-dimethyl-2,5-di(tert-butyl peroxy carbonate), di-tert-butylperoxy trimethyladipate, tris(tert-butyl peroxy)triazine, and vinyltris(tert-butyl peroxy)silane. These initiators may be used alone or in combination. The concentration of the initiator is at least 0.05 parts by weight and preferably 0.1 to 15 parts by weight per 100 parts by weight of a monomer.

The polyester resin has the following composition.

Examples of divalent alcohol components include ethylene glycol, propylene glycol, 1,3-butanediol, 1,4-butanediol, 2,3-butanediol, diethylene glycol, triethylene glycol, 1,5-pentanediol, 12,6-hexanediol, neopentyl glycol, 2-ethyl-1,3-hexanediol, hydrogenated bisphenol A, bisphenols presented by the formula (A) and derivatives thereof:

(A)

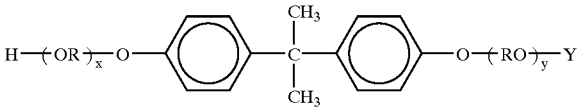

wherein R is ethylene or propylene, x and y each is an integer of 0 or more, and the mean value of x+y is 0 to 10, and diols represented by the formula (B):

(B)

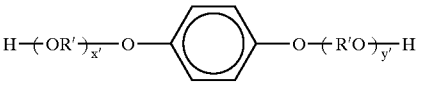

wherein R' is

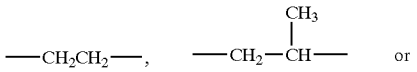

-continued

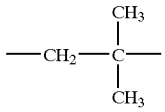

x' and y' each is an integer of 0 or more, and the mean value of x'+y' is 0 to 10.

Examples of divalent acids include dicarboxylic acids, and derivatives thereof such as lower alkyl esters, e.g. phthalic acid, isophthalic acid, and phthalic anhydride; alkyl dicarboxylic acids, and derivatives thereof such as lower alkyl esters, e.g. adipic acid, sebacic acid, and azelaic acid; alkenyl succinic acids and alkyl succinic acids, and anhydrides and lower alkyl esters thereof, e.g. n-dodecyl succinic acid; and unsaturated dicarboxylic acids, and anhydrides and lower alkyl esters thereof, e.g. fumaric acid, maleic acid, citraconic acid, and itaconic acid.

It is preferable that a multivalent alcohol having trivalent or more and/or a multivalent acid having trivalent or more be used in combination. The multivalent alcohol and acid functions as crosslinking agents.

Examples of multivalent alcohols include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxybenzene.

Examples of multivalent acids include trimellitic acid, pyromellitic acid, 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, tetra (methylenecarboxyl)methane, 1,2,7,8-octanetetracarboxylic acid, empol trimer acid, and tetracarboxylic acids represented by the formula:

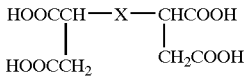

wherein X is alkylene or alkenylene having 1 to 30 carbons and having a branched chain having 1 or more carbon. These multivalent carboxylic acids also may be used as derivatives such as anhydrides or lower alkyl esters.

The content of the alcohol component is preferably in a range of 40 to 60 mol percent and more preferably 45 to 55 mol percent. The content of the acid component is preferably in a range of 60 to 40 mol percent and more preferably 55 to 45 mol percent. The total content of the multivalent alcohol and/or acid is preferably in a range of 1 to 60 mol percent.

The polyester resin is prepared by general condensation of the above-mentioned alcohol component(s) and acid component(s).

The magnetic toner in accordance with the present invention may contain silicone resin, polyurethane, polyamide, epoxy resin, polyvinyl butyral, rosin, modified rosin, terpene resin, phenol resin, and a copolymer of at least two α-olefins. The contents of these compounds must be lower than that of the binding resin.

The magnetic toner in accordance with the present invention has a glass transition temperature of preferably 45° C. to 80° C., and more preferably 50° C. to 70° C.

The binding resin component of the toner in accordance with the present invention, which is soluble to toluene, has an acid value of preferably 0.5 to 50 mgKOH/g, and more preferably 0.5 to 30 mgKOH/g. For a positively charging toner, the acid value is preferably 0.5 to 20 mgKOH/g. A binding resin having such an acid value contributes to improved dispersibility and adhesiveness of the magnetic material because of interaction between the polar section of the binding resin and the polar section of the magnetic iron oxide. Thus, the magnetic toner has high durability. Although the binding resin having such an acid value is negatively charged, the magnetic iron oxide in accordance with the present invention suppresses such charging behavior. As a result, charging is stabilized, and disadvantages caused by negative charging are suppressed.

The acid value of the soluble resin component in the toner is determined as follows.

The basic procedure is based on JIS K-0070.

1) Additives other than the resin component are previously removed before the measurement, or the acid value and the content of the additives other than the resin component are previously determined. Weigh precisely 0.5 to 2.0 g of a pulverized sample to determine the weight W (g) of the resin component.
2) Place the sample into a 300-ml beaker and add 150 ml of a mixture of toluene and ethanol (4:1) in order to dissolve the sample.
3) Titrate the solution with a 0.1-N KOH in ethanol solution using a potentiometric titrator (for example, AT-400 made by Kyoto Electronics Manufacturing, Co., Ltd. in combination with an automatic burette ABP-410 for automatic titration).
4) Calculate the acid factor using the following equation:

$$\text{Acid value (mgKOH/g)}=\{(S-B)\times f\times 5.61\}/W$$

wherein S (ml) is the volume of the consumed KOH solution, B (ml) is the volume of the consumed KOH solution for the blank titration, and f is the factor of the KOH solution.

Examples of waxes contained in the magnetic toner in accordance with the present invention include aliphatic hydrocarbon waxes, e.g. low molecular polyethylene, low molecular polypropylene, olefin copolymers, microcrystalline wax, paraffin wax, and sasol wax; oxides of aliphatic hydrocarbon waxes, such as polyethylene wax oxide, and block copolymers thereof; waxes primarily containing fatty acid ester, e.g. carnauba wax and montan wax; and deoxidated or partially deoxidated fatty acid esters, such as deoxidated carnauba wax. Further examples of usable waxes include linear saturated fatty acids, e.g. palmitic acid, stearic acid, montanic acid, and carboxylic acids having a long alkyl chain; unsaturated fatty acids, e.g. brassidic acid, eleostearic acid, and parinaric acid; saturated alcohols, e.g. stearyl alcohol, aralkyl alcohols, behenyl alcohol, carnaubyl alcohol, ceryl alcohol, melissyl alcohol, and alkyl alcohols having a long chain; polyvalent alcohols, e.g. sorbitol; fatty acid amides, e.g. linolenamide, oleamide, and lauramide; unsaturated fatty acid bisamide, e.g. methylenebisstearamide, ethylenebiscaprinamide, ethylenebislaulamide, and hexamethylenebisstearamide; unsaturated fatty acid amides, e.g. ethylenebisoleamide, hexamethylenebisoleamide, N,N'-dioleyladipamide, and N,N'-dioleylsebacamide; aromatic bisamides, e.g. m-xylenebisstearamide, and N,N'-distearylisophthalamide; aliphatic hydrocarbon waxes grafted with a vinyl monomer such as styrene or acrylic acid; partially esterified compounds of fatty acids with-a polyvalent alcohol, e.g. behenic acid monoglyceride; and methyl esters having hydroxyl groups which are prepared by hydrogenation of vegetable oils.

Examples of preferably used waxes include low-molecular weight alkylene polymers which are produced by high-pressure radical polymerization or low-pressure polymerization using a catalyst such as a Ziegler catalyst; alkylene polymers produced by pyrolysis of high-molecular weight alkylene polymers; low-molecular weight alkylene polymers separated from alkylene polymers as by-products and purified; and waxes having specified components which are extracted from the distillation residue of hydrocarbons formed of carbon monoxide and hydrogen by an Arge process or from synthetic hydrocarbons formed by hydrogenation thereof. These waxes may contain an antioxidant. Other preferable waxes include linear alcohols, fatty acids, acid amides, esters, and montan derivatives. Waxes free of impurities such as fatty acids are also preferable.

Among them, more preferable waxes are primarily composed of hydrocarbons having at most several hundred carbons such as olefin polymers such as polyethylene and by-products thereof, and Fischer-Tropsch waxes. Long chain alkyl alcohols having at most several hundred carbons and terminal hydroxyl groups are also preferable. Further, adducts of alcohols with alkyleleoxides are preferable.

The wax may be fractionated by molecular weight by means of a press sweating process, a solvent process, a vacuum deposition process, a super critical extraction process, or a fractional crystallization process such as a melt precipitation or crystal filtration process. The fractionated wax has a sharp molecular weight distribution which is determined based on a required melting behavior. A wax having a sharp molecular weight distribution imparts a desired plasticity to the binding resin, and thus enhances adhesiveness of the binding resin to the magnetic iron oxide. A hydrocarbon wax is preferable because it does not have releasability. The wax has a molecular weight distribution represented by $M_w/M_n$ of preferably 3.0 or less, more preferably 2.5 or less, and most preferably 2.0 or less.

Examples of materials for inorganic fine powders used as an additive for the magnetic toner in accordance with the present invention include inorganic oxides e.g. silica, alumina, and titanium oxide; carbon black, and fluorocarbons, because these materials can easily form fine powders.

Fine particles of silica, alumina and titanium oxide impart high flowability to the toner when these are dispersed into the toner surface. The average particle size lies in a range of preferably 5 to 200 nm, and more preferably 10 to 100 nm. The base fine powder preferably has a BET specific surface area by nitrogen adsorption of 20 $m^2/g$ or more and particularly 30 to 400 $m^2/g$. The surface treated fine powder preferably has a BET specific surface area of 10 $m^2/g$ or more and particularly 20 to 300 $m^2/g$. These fine powders are added in an amount of 0.03% to 5% by weight of the magnetic toner in order to achieve a desired surface coverage.

The inorganic fine powder preferably has a hydrophobicity of 30% or more. Examples of preferable materials for hydrophobic treatment include silane compounds as silicon surface treatment agents and silicone oils. Examples of such compounds include alkoxysilanes, e.g. dimethylmethoxysilane, trimethylethoxysilane, and butyltrimethoxysilane; and silane compounds, e.g. dimethyldichlorosilane, trimethylchlorosilane, allyldimethylchlorosilane, hexamethyldisilazane, allylphenyldichlorosilane, benzyldimethylchlorosilane, vinyltriethoxysilane, γ-methacryloxypropyltrimethoxysilane, vinyltriacetoxysilane, divinyldichlorosilane and dimethylvinylchlorosilane.

A positively charging compound may be used for adjusting charging. Examples of such compounds include silane coupling agents, e.g. aminopropylmethoxysilane, aminopropylethoxysilane, dimethylaminopropylmethoxysilane, diethylaminopropylmethoxysilane, dipropylaminopropylmethoxysilane, and dibutylaminopropyltrimethoxysilane; and amino-modified silicone oils.

An inorganic powder is preferably added for improving developing characteristics and durability. Examples of inorganic powders include metal oxides, e.g. magnesium, zinc, aluminum, cerium, cobalt, iron, zirconium, chromium, manganese, strontium, tin, and antimony; complex metal oxides, e.g. calcium titanate, magnesium titanate, and strontium titanate; metal salts, e.g. calcium carbonate, magnesium carbonate, and aluminum carbonate; clay components, e.g. kaolin; phosphates, e.g. apatite; silicon compounds, e.g. silicon carbide and silicon nitride; and carbon powders, e.g. carbon black and graphite. Among them, preferred compounds are zinc oxide, aluminum oxide, cobalt oxide, manganese dioxide, strontium titanate and magnesium titanate.

The magnetic toner may contain a lubricating powder, e.g. a fluorine resin such as Teflon or polyvinylidene fluoride; and fluorinated compounds e.g. carbon fluoride.

The magnetic toner in accordance with the present invention preferably contains a charging controlling agent. Examples of positively charging controlling agents include nigrosine and nigrosine modified with a metal salt of a fatty acid; quaternary ammonium salts, e.g. tributylbenzylammonium 1-hydroxy-4-naphtholsulfonate salt and tetrabutylammonium tetrafluoroborate, onium salts such as phosphonium salts, and lake pigments thereof; triphenylmethane dyes and lake pigments thereof (laking agents include phosphotungstic acid, phosphomolybdic acid, phosphotungstomolybdic acid, tannic acid, lauric acid, gallic acid, ferricyanides, and ferrocyanides); metal salts of higher fatty acids; diorganotin oxides, e.g. dibutyltin oxide, dioctyltin oxide, and dicyclohexyltin oxide; diorganotin borates, e.g. dibutyltin borate, dioctyltin borate, and dicyclohexyltin borate; guanidines; and imidazoles. These compounds may be used alone or in combination. Among them, preferable compounds are triphenylmethane, imidazoles, and quaternary ammonium salts having counter ions other than halogen. Examples of polymers for positively charging controlling agents include homopolymers of monomers represented by the formula (1); and copolymers of styrene, acrylate esters, and methacrylate esters:

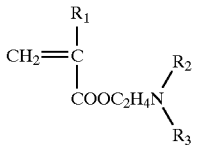

(1)

wherein $R_1$ is H or $CH_3$, and $R_2$ and $R_3$ each is substituted or unsubstituted alkyl preferably of $C_1$ to $C_4$. These positively charging controlling agents also entirely or partly function as the binding resin. In the present invention, triphenylmethane lake pigments represented by the formula (2) and imidazoles are preferably used:

(2)

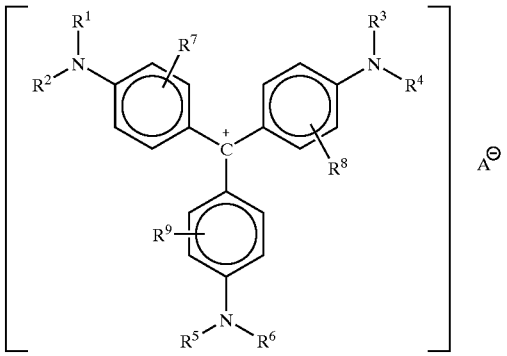

wherein $R^1$, $R^2$, $R^3$, $R^4$, $R^5$ and $R^6$ are halogen, substituted or unsubstituted alkyl, or substituted or unsubstituted aryl and are the same or different from each other; R7, R8 and R9 are hydrogen, halogen, alkyl, or alkoxy, and are the same or different from each other; and $A^{\ominus}$ represents an anion selected from the group consisting of sulfate, nitrate, borate, phosphate, hydroxide, organosulfate, organosulfonate, organophosphate, carboxylate, organoborate and tetrafluoroborate. When the magnetic toner in accordance with the present invention contains such a charging controlling agent, charging adjusting effects by the magnetic iron oxide and charging effects by the charging controlling agent are satisfactorily balanced. Thus, the magnetic toner has excellent durability and environmental stability.

Examples of compounds for negatively charging the magnetic toner include organometallic complexes and chelate compounds, e.g. monoazo metal complexes, acetylacetone metal complexes, and metal complexes of aromatic hydroxycarboxylic acids and aromatic dicarboxylic acids. Other examples include aromatic hydroxycarboxylic acids and aromatic monocarboxylic and polycarboxylic acids, and metal salts, anhydrides, and esters thereof; and phenol derivatives such as bisphenol.

Preferable compounds are azo metal complexes represented by the formula (3):

(3)

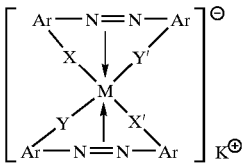

wherein M represents a core metal, such as Sc, Ti, V, Cr, Co, Ni, Mn or Fe; Ar is aryl, such as phenyl or naphthyl, which may have a substituent, such as nitro, halogen, carboxyl, anilide, alkyl having 1 to 18 carbons, and alkoxy having 1 to 18 carbons; X, X', Y and Y' each is —O—, —CO—, —NH—, or —NR— wherein R is alkyl having 1 to 4 carbons; and $K^{\oplus}$ represents a cation, such as hydrogen, sodium, potassium, ammonium or aliphatic ammonium, and is not always present.

Preferable core metals are Fe and Cr, and preferable substituents are halogen, alkyl, and anilide. Examples of preferable counter ions or cations include hydrogen, alkaline metal, ammonium and aliphatic ammonium. A mixture of complexes having different counter ions is also preferably used.

Basic organometallic complexes represented by the formula (4) impart negative charging characteristics to the magnetic toner and can be used in the present invention:

(4)

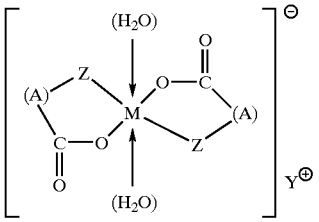

wherein M represents a core metal, such as Cr, Co, Ni, Mn, Fe, Zn, Al, Si or B; A is

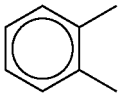

(which may have a substituent group),

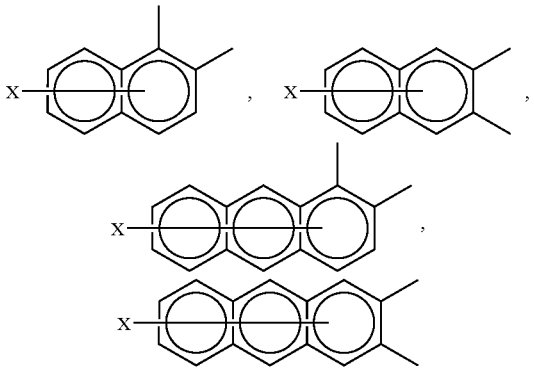

(wherein X is hydrogen, halogen, nitro or alkyl),

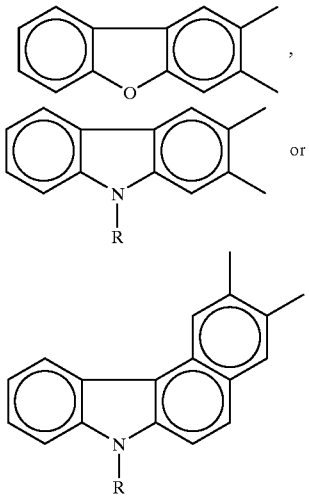

(wherein R is hydrogen, alkyl having 1 to 18 carbons, or alkenyl having 2 to 18 carbons); $Y^{\oplus}$ represents a cation, such as hydrogen, sodium, potassium, ammonium, or aliphatic ammonium, and is not always present; and Z is —O— or

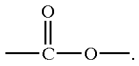

Preferable core metals are Fe, Cr, Si, Zn and Al, preferable substituents are alkyl, anilide, aryl and halogen; and preferable cations or counter ions are hydrogen, ammonium and aliphatic ammonium.

The toner may contain the charging controlling agent at the interior or exterior of the toner. The content of the charging controlling agent depends on the type of the binding resin, other additives, and the toner production process including the dispersion step. Thus, the content is not definitely determined, and lies in a range of generally 0.1 to 10 parts by weight and preferably 0.1 to 5 parts by weight to 100 parts by weight of the binding resin.

The magnetic toner in accordance with the present invention is produced as follows. A binding resin, a magnetic material, a wax, a charging controlling agent and other additives are thoroughly mixed in a mixer, such as a Henschel mixer or a ball mill, and kneaded in a hot kneader, such as a hot roll, a kneader, or an extruder, so that resinous components are sufficiently mixed and other components are dispersed or dissolved into the resinous components. After cooling the melt, the mixture is pulverized and classified. If, necessary, external additives are mixed in a mixer, such as a Henschel mixer.

Since the magnetic material in accordance with the present invention having a uniform particle size distribution shows excellent dispersibility, it can stabilize charging characteristics of the toner. In recent years, toners having a smaller particle size have been used. The magnetic toner in accordance with the present invention can achieve uniform charging, reduced toner agglomeration, improved image density and suppressed fogging even when the weight-average particle size of the toner is 9 $\mu$m or less. These advantages are prominent for the toner having a weight-average particle size of 6.0 $\mu$m or less. Thus, a significantly high definition image is obtainable. A satisfactorily high image density is achieved when the weight-average particle size is 3.0 $\mu$m or more. A conventional toner having a smaller particle size prompts separation of the magnetic material, whereas the toner in accordance with the present invention having high adhesiveness with the binding resin does not cause separation of the magnetic material. Thus, the toner in accordance with the present invention can suppress troubles such as sleeve contamination.

The weight-average particle size of the toner in accordance with the present invention is determined with a Coulter multisizer made by Coulter Ltd. using an electrolyte solution ISOTON R-II (1% NaCl aqueous solution made by Coulter Scientific Japan Co., Ltd.). A dispersant, that is, 0.1 to 5 ml of a surfactant is added to 100 to 150 ml of the electrolyte solution, and then 2 to 20 mg of the toner is added. The electrolytic solution including the toner are dispersed with an ultrasonic agitator for 1 to 3 minutes. The volume and number of particles are measured with the Coulter multisizer and the weight-average particle size is calculated.

For the weight-average particle size of 6 $\mu$m or more, an aperture of 100 $\mu$m is used for measuring the volumes of particles of 2 to 60 $\mu$m. For the weight-average particle size of 3 to 6 $\mu$m, an aperture of 50 $\mu$m is used for measuring the volumes of particles of 1 to 30 $\mu$m. For the weight-average particle size of less than 3.0 $\mu$m, an aperture of 30 $\mu$m is used for measuring the volumes of particles of 0.6 to 18 $\mu$m.

Figure 8:
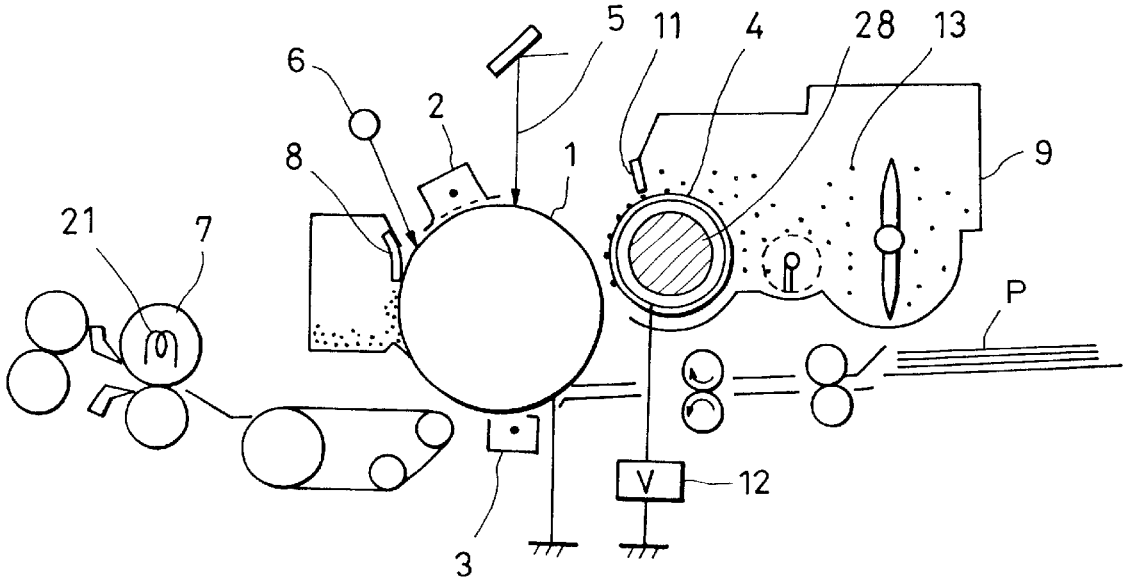
FIG. 8 is a schematic view of an embodiment of an image forming apparatus used in an image forming method of the present invention.
Figure 9:
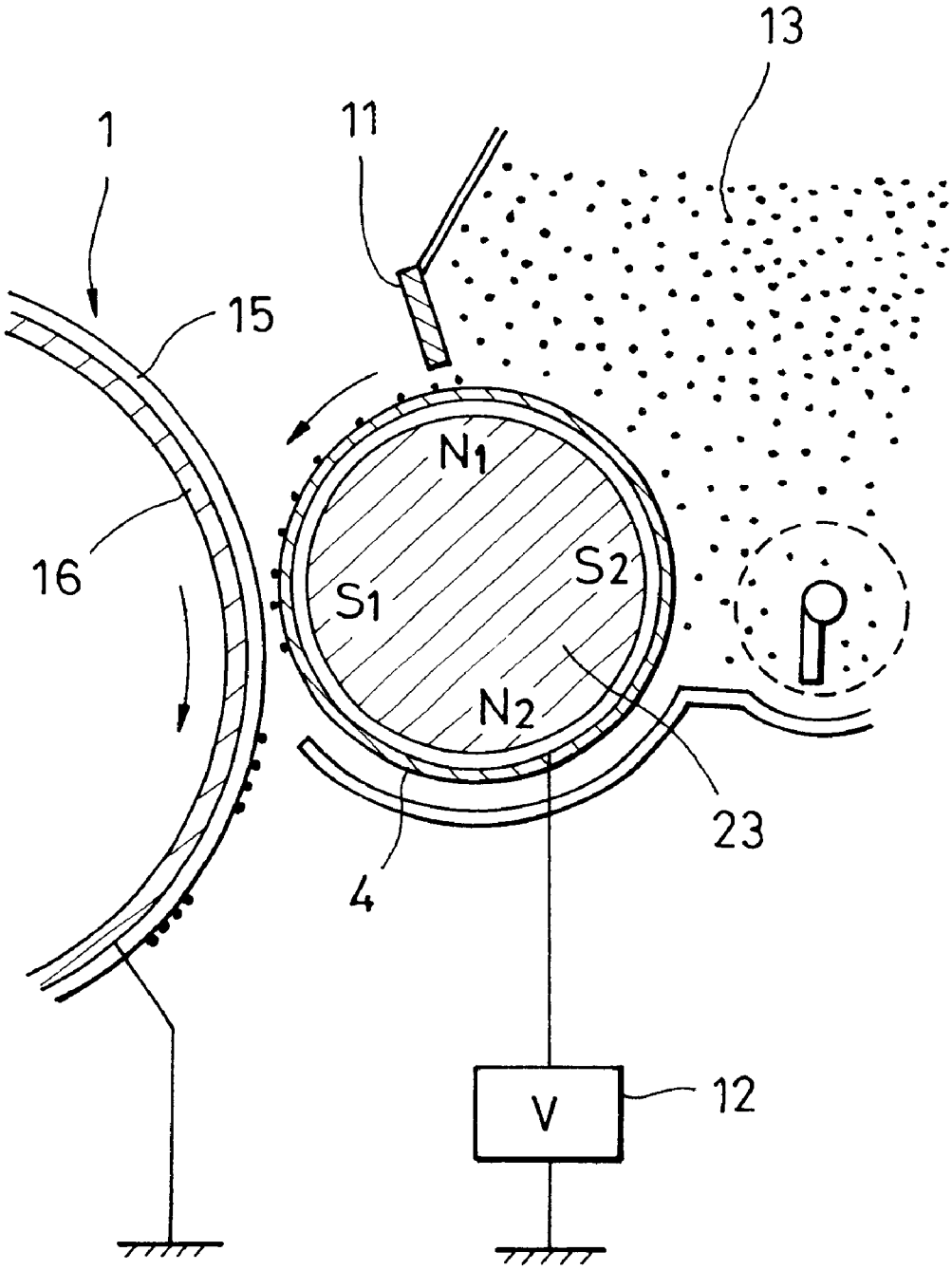
FIG. 9 is an enlarged view of the developing section of the image forming apparatus in FIG. 8.

With reference to FIGS. 8 and 9, the image forming method in accordance with the present invention is described. The surface of a latent image carrier (photosensitive member) 1 is negatively or positively charged with a primary charger 2, and an electrostatic latent image is formed by an analog or laser exposing light beam 5. The electrostatic latent image is developed by reversal or normal development using a magnetic toner 13 in a developing unit 9 provided with a developer carrier (developing sleeve) 4 which includes a magnet 23 having magnetic poles $N_1$, $N_2$, $S_1$ and $S_2$. In the developing section, an alternating current bias, a pulse bias and/or a direct current bias are applied between a conductive substrate 16 of the photosensitive member 1 and the developing sleeve 4 through a biasing means 12. The formed toner image is transferred onto a transfer medium P such as paper. Although the image forming apparatus in FIG. 8 does not have an intermediate transfer member, the image forming apparatus may have an intermediate transfer member. When the transfer medium P travels through the transfer section, the rear face of the transfer medium P away from the photosensitive member 1 is positively or negatively charged so that the negatively or positively charged magnetic toner image on the photosensitive member 1 is electrostatically transferred onto the transfer medium P. After discharging, the transfer medium P is detached from the photosensitive member 1, and then the toner image on the transfer medium P is fixed by a hot pressing roll fixer 7 including a heater 21.

The magnetic toner remaining on the photosensitive member 1 is removed with a cleaner having a cleaning blade 8 after the transfer step. An erasing exposing light beam 6 discharges the cleaned photosensitive member 1. The above-mentioned steps are repeated.

The latent image carrier 1 such as photosensitive drum has a photosensitive layer 15 as well as the conductive substrate 16 and moves in the direction of the arrow. The nonmagnetic cylindrical developing sleeve 4 as a developer carrier rotates in the same direction as that of the surface of the latent image carrier 1. A multipole permanent magnet 23 generating a magnetic field is provided in the nonmagnetic cylindrical developing sleeve 4, such that the multipole permanent magnet 23 does not rotate. The magnetic toner 13 is applied onto the developing sleeve 4 in the developing unit 9. The magnetic toner particles are triboelectrically charged by friction between them and the surface of the developing sleeve 4. A magnetic iron blade 11 is placed near the surface of the cylindrical developing sleeve 4 so that it faces one of the magnetic poles of the multipole permanent magnet 23 so that the thickness of the magnetic toner is uniformly controlled to be 30 to 300 $\mu$m. As a result, a magnetic toner layer which is equal to or thinner than the gap between the latent image carrier 1 and the developing sleeve 4 is formed. The rotation of the developing sleeve 4 is adjusted such that the surface speed of the developing sleeve 4 is substantially the same as or very similar to the surface speed of the latent image carrier 1. A counter magnetic pole may be formed using a permanent magnet instead of the iron magnetic blade 11. An alternating current or pulse bias may be applied to the developing sleeve 4 through a biasing means 12. The alternating bias preferably has a frequency of 200 to 4,000 Hz and a $V_{pp}$ value of 500 to 3,000 V. The magnetic toner particles are transferred onto an electrostatically charged image on the latent image carrier 1 by means of electrostatic force and the alternating current or pulse bias.

An elastic blade composed of an elastic material such as silicone rubber may be used instead of the magnetic blade 11 so that the magnetic toner is applied onto the developing sleeve to form a toner layer of a given thickness by means of the pressure of the elastic blade.

The magnetic toner in accordance with the present invention shows significant advantages when it is used as a positively charging toner in an image forming process which involves reversal development of a digital latent image using a silicon photosensitive drum as the latent image carrier.

Production of Magnetic Material

A magnetic material is produced by forming an iron colloid from an iron salt in an alkaline solution, and then, by oxidizing the iron colloid. Various magnetic materials were prepared by adjusting the timing, the amount, the method, and the pH value with respect to solutions of elements α and β to be added, and also by changing the oxidation conditions and heating conditions.

For example, a magnetic material 1 was synthesized as follows.

Into a reactor containing 20 liters of a 3.0 mol/l aqueous sodium hydroxide solution, 20 liters of an aqueous ferrous sulfate solution containing 1.5 mol/l of $Fe^{2+}$ was added, and then, a ferrous salt suspension containing colloidal ferrous hydroxide salt was formed while maintaining the temperature at 95° C. Next, 0.2 liter of an aqueous sodium silicate solution containing 28 g of a silicon component was added by dropping for 60 minutes while aerating at 100 liters/minute. After stirring for 30 minutes, a ferrous suspension containing magnetite was formed. A 6.0 mol/l aqueous sodium hydroxide solution was added to adjust the pH to 10.0. While aerating at 100 liters/minute, 0.1 liter of an aqueous sodium silicate solution containing 28 g of a silicon component was added by dropping for 30 minutes. After stirring for 30 minutes, particulate magnetite was formed. Then, 150 ml of a 0.5 mol/l aqueous aluminum sulfate solution was added, and vigorously stirred. The magnetite was filtered. The resultant magnetite was washed, dried, and pulverized to produce a magnetic material 1.

With respect to the magnetic materials prepared in accordance with the examples, the compositions are shown in Tables 1 and 2 and the physical properties are shown in Table 3.

TABLE 1

| | Element α | Element β | Main Shape of Magnetic Material | Abundance of Polyhedron Particles having Faces at Ridgeline Portion (% by number) | Abundance of multinuclear particles (% by no.) | Total Abundance (% by number) | Average Particle Diameter (μm) | Maximum Depth of Indented Section of Multinuclear Particle in Two-dimension Projection (%) |
|---|---|---|---|---|---|---|---|---|
| Magnetic Material 1 | Si | A1 | Polyhedron having faces at ridgeline portion of hexahedron + Multinuclear | 8 | 84 | 92 | 0.19 | 5.6 |
| Magnetic Material 2 | Si | A1 | Multinuclear | — | 98 | 98 | 0.21 | 6.8 |
| Magnetic Material 3 | Si | A1 | Polyhedron having faces at ridgeline portion of hexahedron + Multinuclear | 12 | 80 | 92 | 0.18 | 7.1 |
| Magnetic Material 4 | Si | — | Multinuclear | — | 88 | 88 | 0.20 | 3.7 |
| Magnetic Material 5 | Si | — | Polyhedron having faces at ridgeline portion of hexahedron + Multinuclear | 18 | 65 | 83 | 0.19 | 4.4 |
| Magnetic Material 6 | Si | — | Octahedron | 3 | — | 3 | 0.20 | — |
| Magnetic Material 7 | Si | A1 | Sphere | — | 14 | 14 | 0.21 | 0.4 |
| Magnetic Material 8 | P | — | Polyhedron having faces at ridgeline portion of octahedron + Multinuclear | 33 | 54 | 87 | 0.17 | 3.8 |
| Magnetic Material 9 | A1 | — | Multinuclear | — | 83 | 83 | 0.16 | 3.3 |
| Magnetic Material 10 | P | B | Multinuclear | — | 76 | 76 | 0.22 | 2.7 |
| Magnetic Material 11 | A1 | Si | Multinuclear | — | 91 | 91 | 0.23 | 2.4 |
| Magnetic Material 12 | Mg | A1 | Multinuclear | — | 64 | 64 | 0.24 | 1.5 |
| Magnetic Material 13 | Si | — | Hexahedron | 8 | — | 8 | 0.19 | — |
| Magnetic Material 14 | Si | — | Sphere | — | 16 | 16 | 0.21 | 0.6 |
| Magnetic Material 15 | Si | — | Polyhedron having faces at ridgeline portion of hexahedron + Multinuclear | 32 | 19 | 51 | 0.20 | 4.2 |

TABLE 2

| | Element α (% by weight) | $S_1$ (%) | $S_2$ (%) | $S_3$ (%) | Element α at surface: % by weight based on magnetic iron oxide | Element α at surface: % by weight based on total amount of element α | Element β at surface: % by weight based on magnetic iron oxide |
|---|---|---|---|---|---|---|---|
| Magnetic Material 1 | 0.95 | 37 | 14 | 16 | 0.09 | 9.5 | 0.21 |
| Magnetic Material 2 | 1.02 | 41 | 8 | 17 | 0.19 | 18.6 | 0.42 |
| Magnetic Material 3 | 0.98 | 28 | 18 | 18 | 0.04 | 4.1 | 0.10 |
| Magnetic Material 4 | 1.51 | 39 | 11 | 17 | 0.21 | 13.9 | — |
| Magnetic Material 5 | 0.52 | 22 | 15 | 21 | 0.05 | 9.6 | — |
| Magnetic Material 6 | 0.48 | 7 | 34 | 20 | 0.01 | 2.1 | — |
| Magnetic Material 7 | 0.47 | 75 | 4 | 7 | 0.08 | 17.9 | 0.24 |
| Magnetic Material 8 | 1.78 | 18 | 17 | 22 | 0.05 | 2.8 | — |
| Magnetic Material 9 | 1.63 | 33 | 23 | 15 | 0.15 | 9.2 | — |
| Magnetic Material 10 | 2.62 | 43 | 7 | 17 | 0.58 | 22.1 | 0.31 |
| Magnetic Material 11 | 2.06 | 35 | 15 | 18 | 0.35 | 17.0 | 0.12 |
| Magnetic Material 12 | 3.15 | 13 | 28 | 20 | 0.78 | 24.8 | 0.51 |
| Magnetic Material 13 | 0.05 | 21 | 19 | 20 | 0.00 | 0.0 | — |
| Magnetic Material 14 | 4.15 | 81 | 3 | 5 | 1.18 | 28.4 | — |
| Magnetic Material 15 | 0.51 | 14 | 26 | 20 | 0.02 | 3.9 | — |

TABLE 3

| | BET Specific Surface Area ($m^2/g$) | Saturation Magnetization σs ($Am^2/kg$) | Residual Magnetization σr ($Am^2/kg$) | σr/σs | Coercive Force (kA/m) |
|---|---|---|---|---|---|
| Magnetic Material 1 | 10.3 | 87.2 | 8.0 | 0.092 | 7.0 |
| Magnetic Material 2 | 12.7 | 85.9 | 7.0 | 0.082 | 5.9 |
| Magnetic Material 3 | 9.8 | 88.8 | 10.1 | 0.114 | 8.6 |
| Magnetic Material 4 | 13.4 | 85.6 | 8.1 | 0.095 | 7.4 |
| Magnetic Material 5 | 9.7 | 88.1 | 10.5 | 0.115 | 7.7 |
| Magnetic Material 6 | 8.2 | 82.7 | 12.3 | 0.149 | 11.5 |
| Magnetic Material 7 | 8.1 | 84.5 | 5.4 | 0.064 | 6.2 |
| Magnetic Material 8 | 9.3 | 83.8 | 9.2 | 0.110 | 9.0 |
| Magnetic Material 9 | 12.4 | 86.7 | 7.7 | 0.089 | 7.3 |
| Magnetic Material 10 | 11.8 | 82.1 | 9.5 | 0.116 | 9.3 |
| Magnetic Material 11 | 13.1 | 81.9 | 8.8 | 0.107 | 8.4 |
| Magnetic Material 12 | 15.1 | 80.5 | 6.8 | 0.084 | 6.2 |
| Magnetic Material 13 | 7.0 | 86.5 | 11.5 | 0.133 | 10.7 |
| Magnetic Material 14 | 22.5 | 79.4 | 4.6 | 0.058 | 5.1 |
| Magnetic Material 15 | 8.5 | 83.5 | 10.7 | 0.128 | 10.2 |

EXAMPLE 1

| | |
|---|---|
| Styrene-butyl acrylate copolymer (acid value 0) | 100 pbw |
| Magnetic material 1 | 90 pbw |
| Triphenylmethane lake pigment | 2 pbw |
| Fischer-Tropsch wax (Mw/Mn = 1.7) | 4 pbw |

(pbw stands for parts by weight, hereinafter the same.)

The above materials were preliminarily mixed in a Henschel mixer, and then, kneaded using a twin screw extruder at 130° C. The resultant blend was cooled, roughly pulverized with a cutter mill, and finely pulverized with a jet pulverizer. The resultant fine powder was classified with a multi-segment classifier by means of a Coanda effect, and magnetic toner particles having a volume average particle diameter of 7.2 μm were prepared. Then, 0.8 pbw of silica having a BET specific surface area of 90 $m^2/g$ and subjected to hydrophobic treatment with amino-denatured silicone was added to 100 pbw of magnetic toner particles to produce a positively charging magnetic toner. The solubility curve of the magnetic material 1 is shown in FIG. 10.

The magnetic toner was evaluated using a commercially available electrophotographic copier NP-6085 (manufactured by Canon Inc.) having an amorphous silicon drum, in which bias and others had been modified so that reversal development could be performed by using a positively charging magnetic toner, with a drum voltage of 400 V at the non-image section, a drum voltage of 100 V at the image section, a development bias DC-component of 300 V, and an image voltage contrast of 200 V. Copying tests were performed at a temperature of 23° C. and a humidity of 5% RH, and then, at a temperature of 30° C. and a humidity of 80% RH, for 100,000 sheets each.

A high-definition image having a high image density without fog was obtained in both environments. The test results are shown in Tables 4 and 5. With respect to image density, the reflection density of a circular image having a diameter of 5 mm (5 ϕ) was measured with a Macbeth densitometer by using an SPI filter. Fog was evaluated by Ds−Dr using a reflection densitometer (Reflectometer, Model TC-6DS, manufactured by Tokyo Denshoku Co.), where Ds is the worst value of reflection density in the white section after image formation and Dr is the average reflection density of a transfer medium before image formation. A small value indicates increased suppression of fog. In order to evaluate image quality, halftone images of 20 gradations each having an image ratio from 5 to 100% by 5% were copied to evaluate how many gradations were reproduced. A larger number of gradations indicates higher definition copies. The halftone image is composed of binary dots and the excellent reproducibility enables precise development of digital latent images, resulting in excellent development in digital printers and digital copiers.

In addition to the above copying tests, another copying test was performed at a temperature of 23° C. and a humidity of 60% RH for 1,000,000 sheets. Satisfactory images having an image density of 1.40 to 1.42, a fog of 0.2 to 0.8, and an image quality of 18 to 19 were obtained, and a negligible drum abrasion of 2.0 nm/100,000 sheets was observed.

EXAMPLE 2

| | |
|---|---|
| Styrene-butyl acrylate copolymer (acid value 0) | 100 pbw |
| Magnetic material 2 | 90 pbw |
| Triphenylmethane lake pigment | 2 pbw |
| Fischer-Tropsch wax (Mw/Mn = 1.5) | 4 pbw |

The above materials were preliminarily mixed in a Henschel mixer, and then, kneaded using a twin screw extruder at 130° C. The resultant blend was cooled, roughly pulverized with a cutter mill, and finely pulverized with a jet pulverizer. The resultant fine powder was classified with a multi-segment classifier by means of a Coanda effect, and magnetic toner particles having a volume average particle diameter of 7.5 $\mu$m were prepared. Then, 0.8 pbw of silica having a BET specific surface area of 90 $m^2/g$ and subjected to hydrophobic treatment with amino-denatured silicone was added to 100 pbw of magnetic toner particles to produce a positively charging magnetic toner.

The above toner was evaluated similarly to example 1. The results are shown in Tables 4 and 5.

EXAMPLE 3

| | |
|---|---|
| Styrene-butyl acrylate copolymer (acid value 0) | 100 pbw |
| Magnetic material 3 | 90 pbw |
| Triphenylmethane lake pigment | 2 pbw |
| Fischer-Tropsch wax (Mw/Mn = 1.7) | 4 pbw |

The above materials were preliminarily mixed in a Henschel mixer, and then, kneaded using a twin screw extruder at 130° C. The resultant blend was cooled, roughly pulverized with a cutter mill, and finely pulverized with a jet pulverizer. The resultant fine powder was classified with a multi-segment classifier by means of a Coanda effect, and magnetic toner particles having a volume average particle diameter of 7.7 $\mu$m were prepared. Then, 0.8 pbw of silica having a BET specific surface area of 90 $m^2/g$ and subjected to hydrophobic treatment with amino-denatured silicone was added to 100 pbw of magnetic toner particles to produce a positively charging magnetic toner.

The above toner was evaluated similarly to example 1. The results are shown in Tables 4 and 5.

EXAMPLE 4

| | |
|---|---|
| Styrene-butyl acrylate copolymer (acid value 0) | 100 pbw |
| Magnetic material 4 | 90 pbw |
| Triphenylmethane lake pigment | 2 pbw |
| Fischer-Tropsch wax (Mw/Mn = 1.7) | 4 pbw |

The above materials were preliminarily mixed in a Henschel mixer, and then, kneaded using a twin screw extruder at 130° C. The resultant blend was cooled, roughly pulverized with a cutter mill, and finely pulverized with a jet pulverizer. The resultant fine powder was classified with a multi-segment classifier by means of a Coanda effect, and magnetic toner particles having a volume average particle diameter of 7.0 $\mu$m were prepared. Then, 0.8 pbw of silica having a BET specific surface area of 90 $m^2/g$ and subjected to hydrophobic treatment with amino-denatured silicone was added to 100 pbw of magnetic toner particles to produce a positively charging magnetic toner.

The above toner was evaluated similarly to example 1. The results are shown in Tables 4 and 5.

EXAMPLE 5

| | |
|---|---|
| Styrene-butyl acrylate copolymer (acid value 0) | 100 pbw |
| Magnetic material 5 | 90 pbw |
| Triphenylmethane lake pigment | 2 pbw |
| Fischer-Tropsch wax (Mw/Mn = 1.7) | 4 pbw |

The above materials were preliminarily mixed in a Henschel mixer, and then, kneaded using a twin screw extruder at 130° C. The resultant blend was cooled, roughly pulverized with a cutter mill, and finely pulverized with a jet pulverizer. The resultant fine powder was classified with a multi-segment classifier by means of a Coanda effect, and magnetic toner particles having a volume average particle diameter of 6.8 $\mu$m were prepared. Then, 0.9 pbw of silica having a BET specific surface area of 90 $m^2/g$ and subjected to hydrophobic treatment with amino-denatured silicone was added to 100 pbw of magnetic toner particles to produce a positively charging magnetic toner.

The above toner was evaluated similarly to example 1. The results are shown in Tables 4 and 5.

Comparative Example 1

| | |
|---|---|
| Styrene-butyl acrylate copolymer (acid value 0) | 100 pbw |
| Magnetic material 6 | 90 pbw |
| Triphenylmethane lake pigment | 2 pbw |
| Fischer-Tropsch wax (Mw/Mn = 1.7) | 4 pbw |

Figure 11:
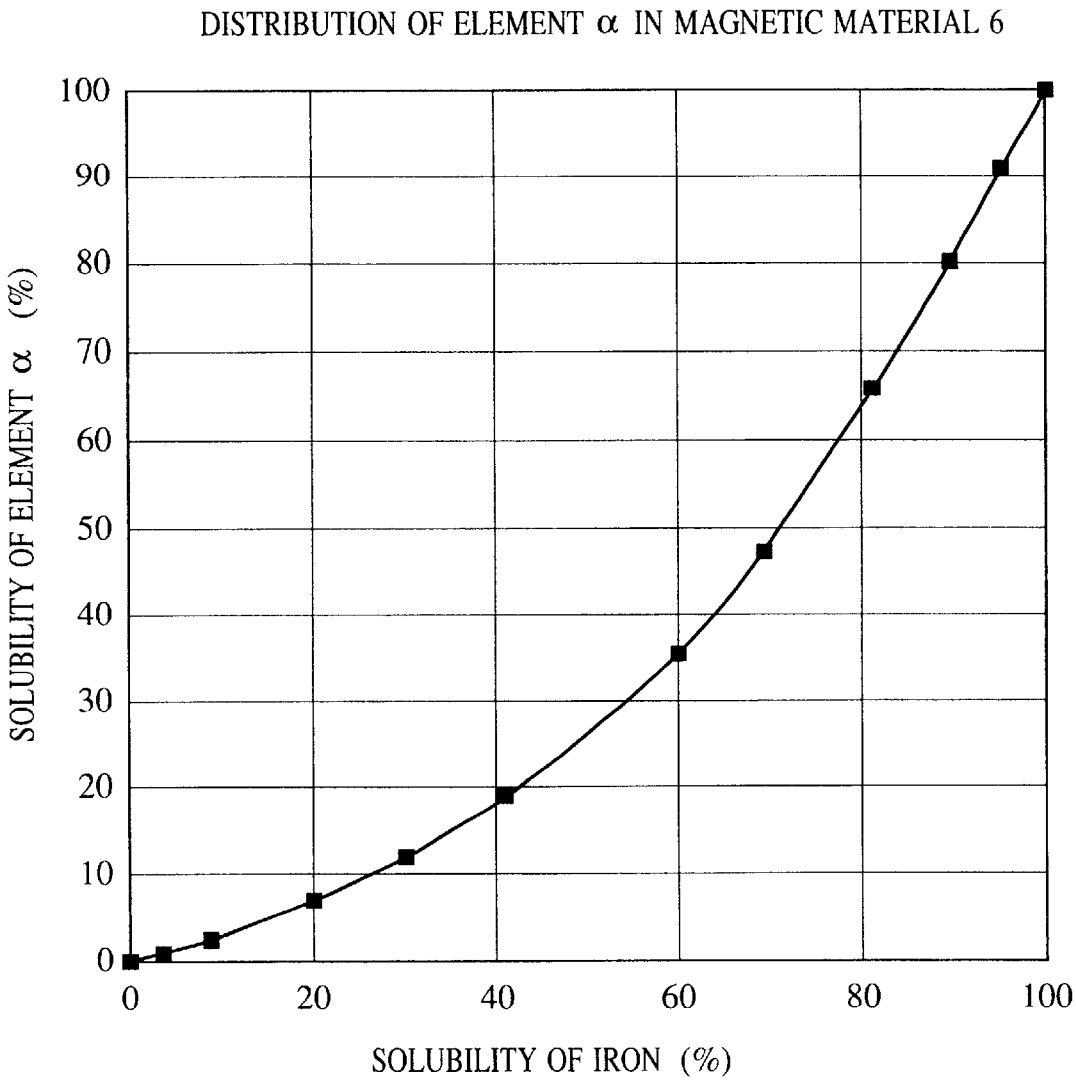
FIG. 11 is a graph of solubility of an element α in a magnetic material 6.

The above materials were preliminarily mixed in a Henschel mixer, and then, kneaded using a twin screw extruder at 130° C. The resultant blend was cooled, roughly pulverized with a cutter mill, and finely pulverized with a jet pulverizer. The resultant fine powder was classified with a multi-segment classifier by means of a Coanda effect, and magnetic toner particles having a volume average particle diameter of 7.6 $\mu$m were prepared. Then, 0.8 pbw of silica having a BET specific surface area of 90 $m^2/g$ and subjected to hydrophobic treatment with amino-denatured silicone was added to 100 pbw of magnetic toner particles to produce a positively charging magnetic toner. The solubility curve of the magnetic material 6 is shown in FIG. 11.

The above toner was evaluated similarly to example 1. The results are shown in Tables 4 and 5.

Comparative Example 2

| | |
|---|---|
| Styrene-butyl acrylate copolymer (acid value 0) | 100 pbw |
| Magnetic material 7 | 90 pbw |
| Triphenylmethane lake pigment | 2 pbw |
| Fischer-Tropsch wax (Mw/Mn = 1.7) | 4 pbw |

Figure 12:
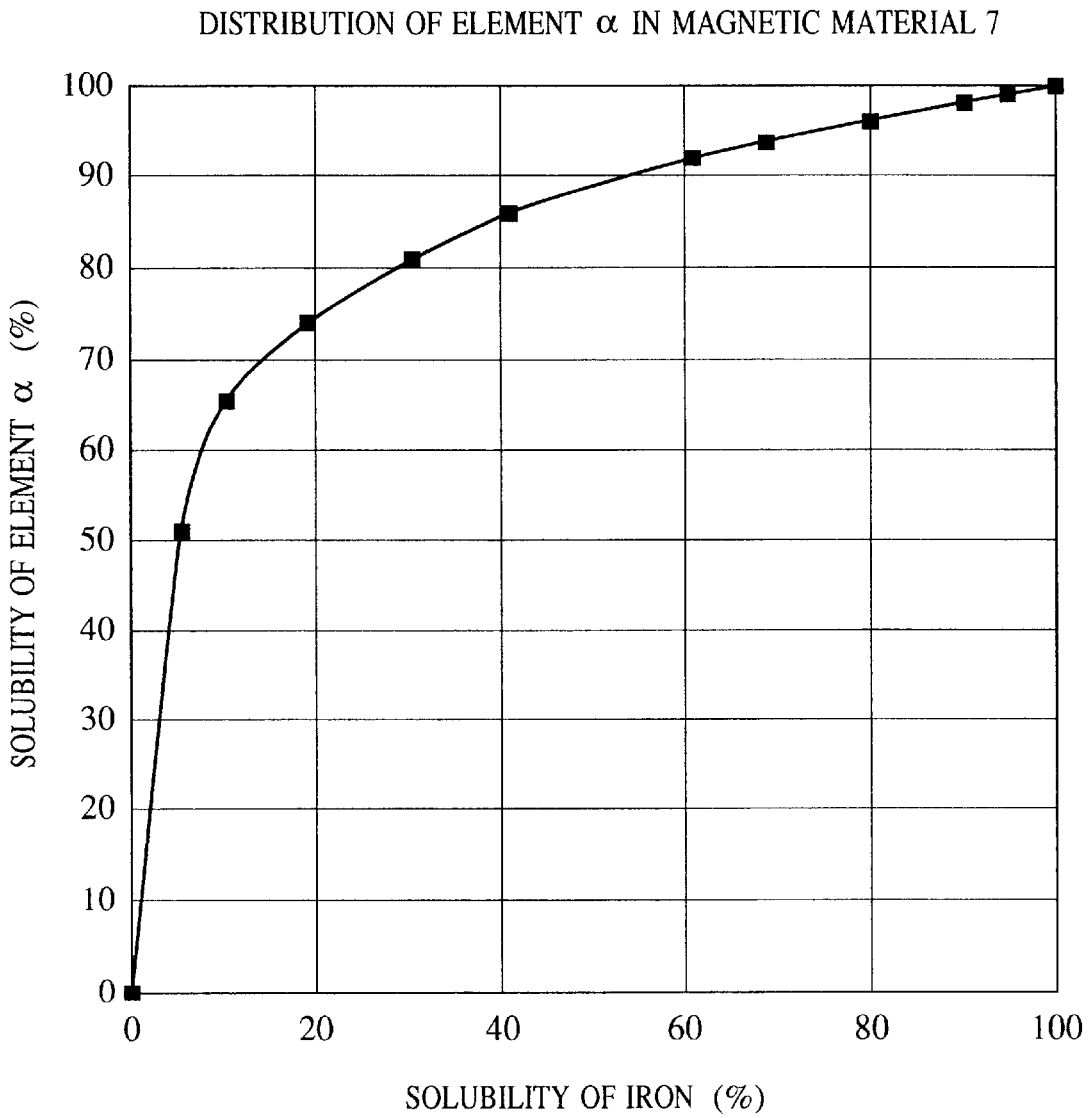
FIG. 12 is a graph of solubility of an element α in a magnetic material 7.

The above materials were preliminarily mixed in a Henschel mixer, and then, kneaded using a twin screw extruder at 130° C. The resultant blend was cooled, roughly pulverized with a cutter mill, and finely pulverized with a jet pulverizer. The resultant fine powder was classified with a multi-segment classifier by means of a Coanda effect, and magnetic toner particles having a volume average particle diameter of 7.2 $\mu$m were prepared. Then, 0.8 pbw of silica having a BET specific surface area of 90 $m^2/g$ and subjected to hydrophobic treatment with amino-denatured silicone was added to 100 pbw of magnetic toner particles to produce a positively charging magnetic toner. The solubility curve of the magnetic material 7 is shown in FIG. 12.

The above toner was evaluated similarly to example 1. The results are shown in Tables 4 and 5.

Comparative Example 3

| | |
|---|---|
| Styrene-butyl acrylate copolymer (acid value 0) | 100 pbw |
| Magnetic material 13 | 90 pbw |
| Triphenylmethane lake pigment | 2 pbw |
| Fischer-Tropsch wax (Mw/Mn = 1.7) | 4 pbw |

The above materials were preliminarily mixed in a Henschel mixer, and then, kneaded using a twin screw extruder at 130° C. The resultant blend was cooled, roughly pulverized with a cutter mill, and finely pulverized with a jet pulverizer. The resultant fine powder was classified with a multi-segment classifier by means of a Coanda effect, and magnetic toner particles having a volume average particle diameter of 7.5 $\mu$m were prepared. Then, 0.8 pbw of silica having a BET specific surface area of 90 $m^2/g$ and subjected to hydrophobic treatment with amino-denatured silicone was added to 100 pbw of magnetic toner particles to produce a positively charging magnetic toner.

The above toner was evaluated similarly to example 1. The results are shown in Tables 4 and 5.

Comparative Example 4

| | |
|---|---|
| Styrene-butyl acrylate copolymer (acid value 0) | 100 pbw |
| Magnetic material 14 | 90 pbw |
| Triphenylmethane lake pigment | 2 pbw |
| Fischer-Tropsch wax (Mw/Mn = 1.7) | 4 pbw |

The above materials were preliminarily mixed in a Henschel mixer, and then, kneaded using a twin screw extruder at 130° C. The resultant blend was cooled, roughly pulverized with a cutter mill, and finely pulverized with a jet pulverizer. The resultant fine powder was classified with a multi-segment classifier by means of a Coanda effect, and magnetic toner particles having a volume average particle diameter of 7.7 $\mu$m were prepared. Then, 0.8 pbw of silica having a BET specific surface area of 90 $m^2/g$ and subjected to hydrophobic treatment with amino-denatured silicone was added to 100 pbw of magnetic toner particles to produce a positively charging magnetic toner.

The above toner was evaluated similarly to example 1. The results are shown in Tables 4 and 5.

Comparative Example 5

| | |
|---|---|
| Styrene-butyl acrylate copolymer (acid value 0) | 100 pbw |
| Magnetic material 15 | 90 pbw |
| Triphenylmethane lake pigment | 2 pbw |
| Fischer-Tropsch wax (Mw/Mn = 1.7) | 4 pbw |

The above materials were preliminarily mixed in a Henschel mixer, and then, kneaded using a twin screw extruder at 130° C. The resultant blend was cooled, roughly pulverized with a cutter mill, and finely pulverized with a jet pulverizer. The resultant fine powder was classified with a multi-segment classifier by means of a Coanda effect, and magnetic toner particles having a volume average particle diameter of 7.9 $\mu$m were prepared. Then, 0.8 pbw of silica having a BET specific surface area of 90 $m^2/g$ and subjected to hydrophobic treatment with amino-denatured silicone was added to 100 pbw of magnetic toner particles to produce a positively charging magnetic toner.

The above toner was evaluated similarly to example 1. The results are shown in Tables 4 and 5.

EXAMPLE 6

| | |
|---|---|
| Styrene-butyl acrylate-monobutyl maleate copolymer (acid value 2.0) | 100 pbw |
| Magnetic material 1 | 90 pbw |
| Imidazole compound | 2 pbw |
| Fischer-Tropsch wax (Mw/Mn = 1.4) | 4 pbw |

The above materials were preliminarily mixed in a Henschel mixer, and then, kneaded using a twin screw extruder at 130° C. The resultant blend was cooled, roughly pulverized with a cutter mill, and finely pulverized with a jet pulverizer. The resultant fine powder was classified with a multi-segment classifier by means of a Coanda effect, and magnetic toner particles having a volume average particle diameter of 6.6 $\mu$m were prepared. Then, 1.0 pbw of silica having a BET specific surface area of 90 $m^2/g$ and subjected to hydrophobic treatment with amino-denatured silicone was added to 100 pbw of magnetic toner particles to produce a positively charging magnetic toner.

The above toner was evaluated similarly to example 1. The results are shown in Tables 4 and 5.

EXAMPLE 7

| | |
|---|---|
| Styrene-butyl acrylate-monobutyl maleate copolymer (acid value 1.2) | 100 pbw |
| Magnetic material 2 | 90 pbw |

-continued

| | |
|---|---|
| Imidazole compound | 2 pbw |
| Fischer-Tropsch wax (Mw/Mn = 1.4) | 4 pbw |

The above materials were preliminarily mixed in a Henschel mixer, and then, kneaded using a twin screw extruder at 130° C. The resultant blend was cooled, roughly pulverized with a cutter mill, and finely pulverized with a jet pulverizer. The resultant fine powder was classified with a multi-segment classifier by means of a Coanda effect, and magnetic toner particles having a volume average particle diameter of 6.7 $\mu$m were prepared. Then, 1.0 pbw of silica having a BET specific surface area of 90 $m^2/g$ and subjected to hydrophobic treatment with amino-denatured silicone was added to 100 pbw of magnetic toner particles to produce a positively charging magnetic toner.

The above toner was evaluated similarly to example 1. The results are shown in Tables 4 and 5.

EXAMPLE 8

| | |
|---|---|
| Styrene-butyl acrylate-monobutyl maleate copolymer (acid value 0.8) | 100 pbw |
| Magnetic material 3 | 90 pbw |
| Imidazole compound | 2 pbw |
| Fischer-Tropsch wax (Mw/Mn = 1.4) | 4 pbw |

The above materials were preliminarily mixed in a Henschel mixer, and then, kneaded using a twin screw extruder at 130° C. The resultant blend was cooled, roughly pulverized with a cutter mill, and finely pulverized with a jet pulverizer. The resultant fine powder was classified with a multi-segment classifier by means of a Coanda effect, and magnetic toner particles having a volume average particle diameter of 6.4 $\mu$m were prepared. Then, 1.0 pbw of silica having a BET specific surface area of 90 $m^2/g$ and subjected to hydrophobic treatment with amino-denatured silicone was added to 100 pbw of magnetic toner particles to produce a positively charging magnetic toner.

The above toner was evaluated similarly to example 1. The results are shown in Tables 4 and 5.

EXAMPLE 9

| | |
|---|---|
| Styrene-butyl acrylate-monobutyl maleate copolymer (acid value 4.0) | 100 pbw |
| Magnetic material 4 | 90 pbw |
| Imidazole compound | 2 pbw |
| Fischer-Tropsch wax (Mw/Mn = 1.4) | 4 pbw |

The above materials were preliminarily mixed in a Henschel mixer, and then, kneaded using a twin screw extruder at 130° C. The resultant blend was cooled, roughly pulverized with a cutter mill, and finely pulverized with a jet pulverizer. The resultant fine powder was classified with a multi-segment classifier by means of a Coanda effect, and magnetic toner particles having a volume average particle diameter of 6.4 $\mu$m were prepared. Then, 1.0 pbw of silica having a BET specific surface area of 90 $m^2/g$ and subjected to hydrophobic treatment with amino-denatured silicone was added to 100 pbw of magnetic toner particles to produce a positively charging magnetic toner.

The above toner was evaluated similarly to example 1. The results are shown in Tables 4 and 5.

EXAMPLE 10

| | |
|---|---|
| Polyester resin (acid value 18.0) | 100 pbw |
| Magnetic material 5 | 90 pbw |
| Monoazo iron complex | 2 pbw |
| Polypropylene wax (Mw/Mn = 3.5) | 4 pbw |

The above materials were preliminarily mixed in a Henschel mixer, and then, kneaded using a twin screw extruder at 130° C. The resultant blend was cooled, roughly pulverized with a cutter mill, and finely pulverized with a jet pulverizer. The resultant fine powder was classified with a multi-segment classifier by means of a Coanda effect, and magnetic toner particles having a volume average particle diameter of 7.3 $\mu$m were prepared. Then, 1.0 pbw of silica having a BET specific surface area of 160 $m^2/g$ and subjected to hydrophobic treatment with hexamethyldisilazane was added to 100 pbw of magnetic toner particles to produce a negatively charging magnetic toner. With respect to this toner, copying tests were performed, by using a commercially available electrophotographic copier NP-6085 (manufactured by Canon Inc.), at a temperature of 23° C. and a humidity of 5% RH, and then, at a temperature of 30° C. and a humidity of 80% RH, for 100,000 sheets each. The results are shown in Tables 4 and 5.

EXAMPLE 11

| | |
|---|---|
| Styrene-butyl acrylate-monobutyl maleate copolymer (acid value 2.0) | 100 pbw |
| Magnetic material 8 | 90 pbw |
| Triphenylmethane lake pigment | 2 pbw |
| Polyethylene wax (Mw/Mn = 2.2) | 4 pbw |

The above materials were preliminarily mixed in a Henschel mixer, and then, kneaded using a twin screw extruder at 130° C. The resultant blend was cooled, roughly pulverized with a cutter mill, and finely pulverized with a jet pulverizer. The resultant fine powder was classified with a multi-segment classifier by means of a Coanda effect, and magnetic toner particles having a volume average particle diameter of 7.6 $\mu$m were prepared. Then, 0.8 pbw of silica having a BET specific surface area of 90 $m^2/g$ and subjected to hydrophobic treatment with amino-denatured silicone was added to 100 pbw of magnetic toner particles to produce a positively charging magnetic toner.

The above toner was evaluated similarly to example 1. The results are shown in Tables 4 and 5.

EXAMPLE 12

| | |
|---|---|
| Styrene-butyl acrylate-monobutyl maleate copolymer (acid value 2.0) | 100 pbw |
| Magnetic material 9 | 90 pbw |
| Triphenylmethane lake pigment | 2 pbw |
| Polyethylene wax (Mw/Mn = 2.2) | 4 pbw |

The above materials were preliminarily mixed in a Henschel mixer, and then, kneaded using a twin screw extruder at 130° C. The resultant blend was cooled, roughly pulverized with a cutter mill, and finely pulverized with a jet pulverizer. The resultant fine powder was classified with a multi-segment classifier by means of a Coanda effect, and magnetic toner particles having a volume average particle diameter of 7.8 μm were prepared. Then, 0.8 pbw of silica having a BET specific surface area of 90 $m^2/g$ and subjected to hydrophobic treatment with amino-denatured silicone was added to 100 pbw of magnetic toner particles to produce a positively charging magnetic toner.

The above toner was evaluated similarly to example 1.

The results are shown in Tables 4 and 5.

EXAMPLE 13

| | |
|---|---|
| Styrene-butyl acrylate-monobutyl maleate copolymer (acid value 2.0) | 100 pbw |
| Magnetic material 10 | 90 pbw |
| Triphenylmethane lake pigment | 2 pbw |
| Polyethylene wax (Mw/Mn = 2.2) | 4 pbw |

The above materials were preliminarily mixed in a Henschel mixer, and then, kneaded using a twin screw extruder at 130° C. The resultant blend was cooled, roughly pulverized with a cutter mill, and finely pulverized with a jet pulverizer. The resultant fine powder was classified with a multi-segment classifier by means of a Coanda effect, and magnetic toner particles having a volume average particle diameter of 7.4 μm were prepared. Then, 0.8 pbw of silica having a BET specific surface area of 90 $m^2/g$ and subjected to hydrophobic treatment with amino-denatured silicone was added to 100 pbw of magnetic toner particles to produce a positively charging magnetic toner.

The above toner was evaluated similarly to example 1. The results are shown in Tables 4 and 5.

EXAMPLE 14

| | |
|---|---|
| Styrene-butyl acrylate-monobutyl maleate copolymer (acid value 2.0) | 100 pbw |
| Magnetic material 11 | 90 pbw |
| Triphenylmethane lake pigment | 2 pbw |
| Polyethylene wax (Mw/Mn = 2.6) | 4 pbw |

The above materials were preliminarily mixed in a Henschel mixer, and then, kneaded using a twin screw extruder at 130° C. The resultant blend was cooled, roughly pulverized with a cutter mill, and finely pulverized with a jet pulverizer. The resultant fine powder was classified with a multi-segment classifier by means of a Coanda effect, and magnetic toner particles having a volume average particle diameter of 7.7 μm were prepared. Then, 0.8 pbw of silica having a BET specific surface area of 90 $m^2/g$ and subjected to hydrophobic treatment with amino-denatured silicone was added to 100 pbw of magnetic toner particles to produce a positively charging magnetic toner.

The above toner was evaluated similarly to example 1. The results are shown in Tables 4 and 5.

EXAMPLE 15

| | |
|---|---|
| Styrene-butyl acrylate-monobutyl maleate copolymer (acid value 2.0) | 100 pbw |
| Magnetic material 12 | 90 pbw |
| Triphenylmethane lake pigment | 2 pbw |
| Polyethylene wax (Mw/Mn = 2.6) | 4 pbw |

The above materials were preliminarily mixed in a Henschel mixer, and then, kneaded using a twin screw extruder at 130° C. The resultant blend was cooled, roughly pulverized with a cutter mill, and finely pulverized with a jet pulverizer. The resultant fine powder was classified with a multi-segment classifier by means of a Coanda effect, and magnetic toner particles having a volume average particle diameter of 7.2 μm were prepared. Then, 0.8 pbw of silica having a BET specific surface area of 90 $m^2/g$ and subjected to hydrophobic treatment with amino-denatured silicone was added to 100 pbw of magnetic toner particles to produce a positively charging magnetic toner.

The above toner was evaluated similarly to example 1. The results are shown in Tables 4 and 5.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

TABLE 4

| | At a temperature of 23° C. and a humidity of 5% RH | | | | | | |
|---|---|---|---|---|---|---|---|
| | | Initial | | | After 100,000 operations | | |
| | Drum Abrasion nm/ 100,000 sheets | Density | Fog | Image Quality | Density | Fog | Image Quality |
| Example 1 | 2.1 | 1.42 | 0.5 | 19 | 1.45 | 0.7 | 19 |
| Example 2 | 6.6 | 1.35 | 0.8 | 17 | 1.38 | 0.9 | 17 |
| Example 3 | 3.3 | 1.38 | 0.7 | 18 | 1.40 | 0.8 | 18 |
| Example 4 | 5.8 | 1.40 | 0.4 | 19 | 1.46 | 0.5 | 19 |
| Example 5 | 4.2 | 1.41 | 0.3 | 19 | 1.47 | 0.4 | 19 |
| Comparative Example 1 | 5.1 | 1.32 | 1.1 | 17 | 1.32 | 1.4 | 16 |

TABLE 4-continued

| | At a temperature of 23° C. and a humidity of 5% RH | | | | | | |
|---|---|---|---|---|---|---|---|
| | | Initial | | | After 100,000 operations | | |
| | Drum Abrasion nm/ 100,000 sheets | Density | Fog | Image Quality | Density | Fog | Image Quality |
| Comparative Example 2 | 72.3 | 1.41 | 2.2 | 17 | 1.30 | 2.7 | 15 |
| Comparative Example 3 | 23.6 | 1.40 | 1.6 | 17 | 1.34 | 1.8 | 16 |
| Comparative Example 4 | 154.7 | 1.32 | 2.1 | 17 | 1.33 | 1.2 | 15 |
| Comparative Example 5 | 16.8 | 1.34 | 1.2 | 17 | 1.35 | 1.1 | 16 |
| Example 6 | 1.6 | 1.45 | 0.4 | 20 | 1.48 | 0.5 | 19 |
| Example 7 | 5.8 | 1.40 | 0.6 | 18 | 1.44 | 0.7 | 17 |
| Example 8 | 1.5 | 1.41 | 0.5 | 18 | 1.44 | 0.6 | 19 |
| Example 9 | 4.4 | 1.43 | 0.3 | 19 | 1.48 | 0.4 | 19 |
| Example 10 | 3.1 | 1.44 | 0.2 | 19 | 1.49 | 0.3 | 19 |
| Example 11 | 8.7 | 1.40 | 0.5 | 19 | 1.42 | 0.7 | 19 |
| Example 12 | 7.8 | 1.39 | 0.4 | 18 | 1.41 | 0.5 | 18 |
| Example 13 | 9.9 | 1.37 | 0.8 | 19 | 1.40 | 0.6 | 19 |
| Example 14 | 9.1 | 1.38 | 0.9 | 18 | 1.40 | 0.8 | 18 |
| Example 15 | 12.3 | 1.35 | 1.0 | 17 | 1.36 | 0.9 | 17 |

TABLE 5

| | At a temperature of 30° C. and a humidity of 80% RH | | | | | | |
|---|---|---|---|---|---|---|---|
| | | Initial | | | After 100,000 operations | | |
| | Drum Abrasion nm/ 100,000 sheets | Density | Fog | Image Quality | Density | Fog | Image Quality |
| Example 1 | 1.8 | 1.40 | 0.3 | 19 | 1.40 | 0.4 | 18 |
| Example 2 | 6.1 | 1.32 | 0.6 | 17 | 1.34 | 0.7 | 16 |
| Example 3 | 2.9 | 1.36 | 0.5 | 18 | 1.37 | 0.6 | 17 |
| Example 4 | 5.1 | 1.41 | 0.3 | 19 | 1.40 | 0.3 | 18 |
| Example 5 | 3.9 | 1.41 | 0.4 | 19 | 1.41 | 0.5 | 18 |
| Comparative Example 1 | 4.7 | 1.30 | 0.6 | 16 | 1.24 | 1.2 | 14 |
| Comparative Example 2 | 68.4 | 1.41 | 1.8 | 17 | 1.30 | 1.9 | 15 |
| Comparative Example 3 | 21.5 | 1.31 | 1.4 | 17 | 1.31 | 1.3 | 15 |
| Comparative Example 4 | 138.7 | 1.22 | 1.2 | 17 | 1.26 | 1.7 | 15 |
| Comparative Example 5 | 15.3 | 1.31 | 1.0 | 17 | 1.32 | 1.1 | 15 |
| Example 6 | 1.4 | 1.42 | 0.4 | 20 | 1.44 | 0.4 | 19 |
| Example 7 | 4.4 | 1.39 | 0.5 | 18 | 1.42 | 0.6 | 17 |
| Example 8 | 1.2 | 1.40 | 0.4 | 18 | 1.42 | 0.5 | 18 |
| Example 9 | 3.6 | 1.40 | 0.3 | 19 | 1.44 | 0.3 | 19 |
| Example 10 | 2.9 | 1.41 | 0.2 | 19 | 1.43 | 0.3 | 19 |
| Example 11 | 8.1 | 1.35 | 0.5 | 19 | 1.39 | 0.7 | 18 |
| Example 12 | 7.2 | 1.37 | 0.4 | 18 | 1.38 | 0.5 | 18 |
| Example 13 | 9.5 | 1.36 | 0.8 | 19 | 1.39 | 0.6 | 18 |
| Example 14 | 8.4 | 1.35 | 0.9 | 18 | 1.39 | 0.8 | 17 |
| Example 15 | 11.5 | 1.32 | 1.0 | 17 | 1.33 | 0.9 | 16 |

What is claimed is:

1. A magnetic toner comprising a magnetic toner particle containing at least a binding resin and a magnetic material;

wherein the magnetic material comprises a magnetic iron oxide and contains 0.10% to 4.00% by weight of an element α from the third period to the seventh period with an atomic number of 11 to 103 in the long-period Periodic Table and having an electronegativity of 0.1 to 2.5;

the solubility $S_1$ of the element α in said magnetic material at an iron solubility of 0% to 20% lies in a range from 10% to less than 44%, the solubility $S_2$ of the element α in said magnetic material at an iron solubility of 80% to 100% lies in a range from 5% to less than 30%; and said magnetic material is selected from the group consisting of (i) a magnetic material containing at least 60% by number of multinuclear magnetic iron oxide particles based on magnetic iron oxide particles, (ii) a magnetic material containing at least 50% by number based on magnetic iron oxide particles of multinuclear magnetic iron oxide particles and at least 60% by number in total, based on magnetic iron oxide particles, of polyhedral magnetic iron oxide particles having faces at ridgeline portion of hexahedron and multinuclear magnetic iron oxide particles, (iii) magnetic material containing at least 50% by number based on magnetic iron oxide particles of multinuclear magnetic iron oxide particles and at least 60% by number in total, based on magnetic iron oxide particles, of polyhedral magnetic iron oxide particles having faces at ridgeline portion of octahedron and multinuclear magnetic iron oxide particles, and (iv) magnetic material containing at least 50% by number based on magnetic iron oxide particles of multinuclear magnetic iron oxide particles and at least 60% by number in total, based on magnetic iron oxide particles, of polyhedral magnetic iron oxide particles having faces at ridgeline portion of hexahedron, polyhedral magnetic iron oxide particles having faces at ridgeline portion of octahedron and multinuclear magnetic iron oxide particles.

2. The magnetic toner according to claim 1, wherein the solubility $S_1$ and the solubility $S_2$ satisfy the relationship $S_1 \geqq S_2$.

3. The magnetic toner according to claim 1, wherein the solubility $S_3$ of the element $\alpha$ is 10% to less than 25%.

4. The magnetic toner according to claim 3, wherein the solubility $S_1$, the solubility $S_2$ and the solubility $S_3$ satisfy the relationships $S_1 > S_2$, $S_1 \geqq S_3$, and $S_3 \geqq S_2$.

5. The magnetic toner according to claim 1, wherein said magnetic material contains 0.15% to 3.00% by weight of the element $\alpha$, the solubility $S_1$ is 15% to less than 42%, and the solubility $S_2$ is 5% to less than 25%.

6. The magnetic toner according to claim 1, wherein said magnetic material contains 0.20% to 2.50% by weight of the element $\alpha$, the solubility $S_1$ is 20% to less than 40%, and the solubility $S_2$ is 10% to less than 20%.

7. The magnetic toner according to claim 1, wherein said magnetic material has a number-average particle diameter of 0.05 to 0.50 $\mu$m.

8. The magnetic toner according to claim 1, wherein the element $\alpha$ is selected from the group consisting of Si, Al, P, V, Cr, Co, Ni, Cu, Zn, Ga, Ge, Zr, Sn and Pb.

9. The magnetic toner according to claim 1, wherein the element $\alpha$ is selected from the group consisting of Si, Al and P.

10. The magnetic toner according to claim 1, wherein the element $\alpha$ is Si.

11. The magnetic toner according to claim 1, wherein said magnetic toner has a weight-average particle diameter of 3.0 to 9.0 $\mu$m.

12. The magnetic toner according to claim 1, wherein said magnetic material is contained in an amount of 20 to 200 parts by weight to 100 parts of said binding resin.

13. The magnetic toner according to claim 1, wherein said magnetic material is contained in an amount of 40 to 150 parts by weight to 100 parts of said binding resin.

14. The magnetic toner according to claim 1, wherein said magnetic material is contained in an amount of 50 to 120 parts by weight to 100 parts of said binding resin.

15. The magnetic toner according to claim 1, which has positively charging characteristics.

16. The magnetic toner according to claim 1, wherein the element $\alpha$ belongs to the third, fourth or fifth period in the long-period Periodic Table.

17. An image forming method comprising a step of forming an electrostatic image on a latent image carrier and a step of developing the electrostatic image with a magnetic toner to form a magnetic toner image; wherein said magnetic toner comprises a magnetic toner particle containing at least a binding resin and a magnetic material; wherein said magnetic material comprises a magnetic iron oxide and contains 0.10% to 4.00% by weight of an element $\alpha$ from the third period to the seventh period with an atomic number from 11 to 103 in the long period Periodic Table and having an electronegatively of 0.1 to 2.5;

the solubility $S_1$ of the element $\alpha$ in said magnetic material at an iron solubility of 0% to 20% lies in a range from 10% to less than 44%, the solubility $S_2$ of the element $\alpha$ in the magnetic material at an iron solubility of 80% to 100% lies in a range from 5% to less than 30%; and the magnetic material is selected from the group consisting of (i) a magnetic material containing at least 60% by number of multinuclear magnetic iron oxide particles based on magnetic iron oxide particles, (ii) a magnetic material containing at least 50% by number based on magnetic iron oxide particles of multinuclear magnetic iron oxide particles and at least 60% by number in total, based on magnetic iron oxide particles, of polyhedral magnetic iron oxide particles having faces at ridgeline portion of hexahedron and multinuclear magnetic iron oxide particles, (iii) magnetic material containing at least 50% by number based on magnetic iron oxide particles of multinuclear magnetic iron oxide particles and at least 60% by number in total, based on magnetic iron oxide particles, of polyhedral magnetic iron oxide particles having faces at ridgeline portion of octahedron and multinuclear magnetic iron oxide particles, and (iv) magnetic material containing at least 50% by number based on magnetic iron oxide particles of multinuclear magnetic iron oxide particles and at least 60% by number in total, based on magnetic iron oxide particles, of polyhedral magnetic iron oxide particles having faces at ridgeline portion of hexahedron, polyhedral magnetic iron oxide particles having faces at ridgeline portion of octahedron and multinuclear magnetic iron oxide particles.

18. The image forming method according to claim 17, wherein said magnetic toner has positively charging characteristics.

19. The image forming method according to claim 17, wherein said latent image carrier is an amorphous silicon photosensitive drum.

20. The image forming method according to claim 19, wherein the amorphous silicon photosensitive drum is positively charged to form an electrostatic image, and then the electrostatic image is reversely developed with a positively charging magnetic toner.

21. The image forming method according to claim 17, wherein the solubility $S_1$ and the solubility $S_2$ satisfy the relationship $S_1 \geqq S_2$.

22. The image forming method according to claim 17, wherein the solubility $S_3$ of the element $\alpha$ is from 10% to less than 25%.

23. The image forming method according to claim 17, wherein the solubility $S_1$, the solubility $S_2$ and the solubility $S_3$ satisfy the relationships $S_1 > S_2$, $S_1 \geqq S_3$, and $S_3 \geqq S_2$.

24. The image forming method according to claim 17, wherein said magnetic material contains 0.15% to 3.00% by weight of the element α, the solubility $S_1$ is 15% to less than 42%, and the solubility $S_2$ is 5% to less than 25%.

25. The image forming method according to claim 17, wherein said magnetic material contains 0.20% to 2.50% by weight of the element α, the solubility $S_1$ is 20% to less than 40%, and the solubility $S_2$ is 10% to less than 20%.

26. The image forming method according to claim 17, wherein said magnetic material has a number-average particle diameter of 0.05 to 0.50 μm.

27. The image forming method according to claim 17, wherein the element α is selected from the group consisting of Si, Al, P, V, Cr, Co, Ni, Cu, Zn, Ga, Ge, Zr, Sn and Pb.

28. The image forming method according to claim 17, wherein the element α is selected from the group consisting of Si, Al and P.

29. The image forming method according to claim 17, wherein the element α is Si.

30. The image forming method according to claim 17, wherein said magnetic toner has a weight-average particle diameter of 3.0 to 9.0 μm.

31. The image forming method according to claim 17, wherein said magnetic material is contained in an amount of 20 to 200 parts by weight to 100 parts of said binding resin.

32. The image forming method according to claim 17, wherein said magnetic material is contained in an amount of 40 to 150 parts by weight to 100 parts of said binding resin.

33. The image forming method according to claim 17, wherein said magnetic material is contained in an amount of 50 to 120 parts by weight to 100 parts of said binding resin.

34. The image forming method according to claim 17, wherein the element α belongs to the third, fourth or fifth period in the long-period Periodic Table.

* * * * *